US008406666B2

(12) United States Patent
Mikutsu

(10) Patent No.: US 8,406,666 B2
(45) Date of Patent: Mar. 26, 2013

(54) IMAGE FORMING APPARATUS HAVING A GUIDE ASSEMBLY BETWEEN A FIXING UNIT AND CONVEYANCE UNIT, THE GUIDE ASSEMBLY INCLUDING FIRST AND SECOND GUIDE MEMBERS

(75) Inventor: Yasunari Mikutsu, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 371 days.

(21) Appl. No.: 12/792,233

(22) Filed: Jun. 2, 2010

(65) Prior Publication Data

US 2010/0310287 A1 Dec. 9, 2010

(30) Foreign Application Priority Data

Jun. 3, 2009 (JP) ..... 2009-133860

(51) Int. Cl.
*G03G 15/20* (2006.01)

(52) U.S. Cl. ..... 399/322; 399/405

(58) Field of Classification Search ..... 399/322, 399/405, 341
See application file for complete search history.

(56) References Cited

U.S. PATENT DOCUMENTS

| | | | | |
|---|---|---|---|---|
| 5,087,947 | A * | 2/1992 | Torino | 399/322 |
| 5,130,754 | A * | 7/1992 | Hishikawa | 399/322 |
| 7,062,211 | B2 * | 6/2006 | Baba et al. | 399/323 |
| 7,103,307 | B2 * | 9/2006 | Aruga et al. | 399/328 |
| 7,149,463 | B2 * | 12/2006 | Fujisawa et al. | 399/323 |
| 7,526,242 | B2 * | 4/2009 | Takagaki et al. | 399/307 |
| 7,664,415 | B2 | 2/2010 | Mikutsu | |
| 2002/0025204 | A1 * | 2/2002 | Ando et al. | 399/381 |
| 2004/0057741 | A1 * | 3/2004 | Uehara et al. | 399/69 |
| 2008/0075490 | A1 * | 3/2008 | Ota et al. | 399/45 |
| 2012/0057887 | A1 * | 3/2012 | Kameda et al. | 399/44 |

FOREIGN PATENT DOCUMENTS

| | | |
|---|---|---|
| JP | 2002-304072 | 10/2002 |
| JP | 2003-337491 | 11/2003 |
| JP | 2006-3695 | 1/2006 |
| JP | 2007-298811 | 11/2007 |
| JP | 4041728 | 11/2007 |
| JP | 2008-129091 | 6/2008 |

* cited by examiner

*Primary Examiner* — David Gray
*Assistant Examiner* — G. M. Hyder
(74) *Attorney, Agent, or Firm* — Oblon, Spivak, McClelland, Maier & Neustadt, L.L.P.

(57) ABSTRACT

An image forming apparatus includes an electrophotographic imaging unit, a fixing unit, a conveyance unit, and a guide assembly. The electrophotographic imaging unit forms a toner image on a recording medium for forwarding to a media conveyance path. The fixing unit is disposed in the conveyance path to fix the toner image in place on the recording medium through a fixing nip. The conveyance unit is disposed downstream of the fixing unit along the conveyance path to forward the recording medium from the fixing nip. The guide assembly is disposed between the fixing unit and the conveyance unit along the conveyance path to guide the recording medium therethrough. The guide assembly includes a pair of first and second media guide members to form a tapered passageway therebetween to pass the recording medium from the fixing nip into the conveyance unit.

16 Claims, 8 Drawing Sheets

IMAGE FORMING APPARATUS HAVING A GUIDE ASSEMBLY BETWEEN A FIXING UNIT AND CONVEYANCE UNIT, THE GUIDE ASSEMBLY INCLUDING FIRST AND SECOND GUIDE MEMBERS

CROSS-REFERENCE TO RELATED APPLICATIONS

The present patent application claims priority pursuant to 35 U.S.C. §119 from Japanese Patent Application No. 2009-133860 filed on Jun. 3, 2009, which is hereby incorporated by reference herein in its entirety.

BACKGROUND OF THE INVENTION

1. Field of the Invention

The present invention relates to an image forming apparatus, such as photocopier, facsimile, printer, plotter, or multifunctional machine incorporating several of those imaging functions, and more particularly, to an electrophotographic image forming apparatus employing a guide assembly in a media conveyance path along which a recording medium travels after processing through a fixing device that permanently fixes a toner image in place on the recording medium with heat and pressure.

2. Discussion of the Background

In electrophotographic image forming apparatus, such as photocopiers, facsimiles, printers, plotters, or multifunctional machines incorporating several of those imaging functions, an image is formed by attracting toner particles to a photoconductive surface for subsequent transfer to a recording medium such as a sheet of paper. After transfer, the recording sheet is forwarded to a post-transfer sheet conveyance path, where it undergoes a fixing process to permanently fix the toner image in place on the recording sheet by melting and settling toner with heat and pressure.

Various types of fixing processes are known in the art, most of which employ a pair of parallel, elongated fixing members, one being a fuser member heated for fusing toner and the other being a pressure member pressed against the heated one, which together define a heated area of contact, called a fixing nip, through which the recording sheet is ultimately passed under heat and pressure for fixing the toner image. Such fixing members include paired cylindrical rollers, each with or without an endless belt looped for rotation around the roller circumference, rotating in pressure contact with each other to drive a recording sheet forward through the fixing nip.

Currently, an increasing number of electrophotographic systems employ a fixing device with an enlarged fixing nip for obtaining a high-speed, high-productivity, and compact-size fixing process. Enlarging or elongating the fixing nip along the sheets conveyance path means an increased period of dwell time during which a recording sheet is subjected to heat and pressure within the fixing nip, allowing for intensely heating and pressing the recording sheet at higher processing speeds without requiring large equipment or large amounts of energy consumed for heat generation.

Typically, a long, large fixing nip is created by using a combination of a primary fixing roller and an additional, secondary fixing member or roller with a fixing belt entrained around the combined fixing rollers to form one side of the fixing nip (i.e., either a heated, "fuser" side, or a pressed "pressure" side), opposite to which is a single roller that forms the other side of the fixing nip. In this arrangement, the fixing nip extends over a relatively large area of contact, including where the primary fixing roller contacts the opposite roller as well as where the secondary fixing roller contacts the opposite roller, larger than that obtained with a single fuser roller and a single pressure roller.

One problem encountered with use of an enlarged fixing nip is the difficulty in properly conveying a recording sheet from the fixing nip downstream to between a pair of conveyance rollers, such as those employed to forward the recording sheet into an output unit for eventual delivery outside the apparatus, or those defining a heated, glossing nip therebetween which further processes the recording sheet with heat and pressure to provide a glossy and smooth appearance to the printed image after fixing.

The difficulty arises where a recording sheet processed under intense heat and pressure through the fixing nip develops a curl or bend with its edge pointing away from the proper conveyance path to interfere with adjacent surfaces upon exiting the fixing nip. If not corrected, such deformation or deviation causes the sheet to jam the conveyance path, or otherwise crease upon entering the downstream conveyance roller pair. This problem is particularly pronounced where the conveyance rollers are disposed immediately downstream from the fixing nip as is the case with the glossing rollers, which are ideally disposed as close as possible to the fixing nip to provide fixing and glossing processes with high thermal efficiency.

Various methods have been proposed to provide proper sheet conveyance downstream of the fixing nip in the image forming apparatus. A typical approach is to employ a sheet guide that defines a guide surface extending along the sheet conveyance path to push against the edge or surface of a curled recording sheet for correcting deformation and deviation during passage from the fixing nip to downstream processes.

For example, one conventional method uses a guide assembly formed of a plate combined with a protruding structure, such as rollers, spurs, or ribs, that defines an uneven, nonplanar guide surface to pass a recording sheet in an intended direction along the sheet conveyance path. According to this method, using the protruding tracking structure minimizes the area of contact between the guide surface and the recording sheet, which is intended to prevent print defects caused by rubbing the printed face of the recording sheet against the guide surface.

Unfortunately, the conventional guide assembly does not work well where the recording sheet has a significant curl or bend developed through intense heat and pressure, as is the case with processing through the extended fixing nip. Rather, instead of correcting deformation and deviation, this method can adversely affect the print quality where the recording sheet smudges, jams, or creases by striking against the uneven guide surface of the protruding structure.

SUMMARY OF THE INVENTION

Exemplary aspects of the present invention are put forward in view of the above-described circumstances, and provide a novel image forming apparatus.

In one exemplary embodiment, the novel image forming apparatus includes an electrophotographic imaging unit, a fixing unit, a conveyance unit, and a guide assembly. The electrophotographic imaging unit forms a toner image on a recording medium for forwarding to a media conveyance path. The fixing unit is disposed along the conveyance path to fix the toner image in place on the recording medium. The fixing unit has a pair of fixing members, at least one being heated and at least one being pressed against the other one of the pair, to define a fixing nip through which the recording medium is passed under heat and pressure. The conveyance unit is disposed downstream of the fixing unit along the conveyance path to forward the recording medium from the fixing nip. The guide assembly is disposed between the fixing unit and the conveyance unit along the conveyance path to guide the recording medium therethrough. The guide assembly includes a pair of first and second media guide members to form a tapered passageway therebetween narrowing from upstream to downstream along the conveyance path to pass the recording medium from the fixing nip into the conveyance unit. The first guide member defines a substantially smooth, first guide surface to face a printed side of the recording medium on which the toner image is formed. The second guide member defines a second guide surface to face a back side opposite the printed side of the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
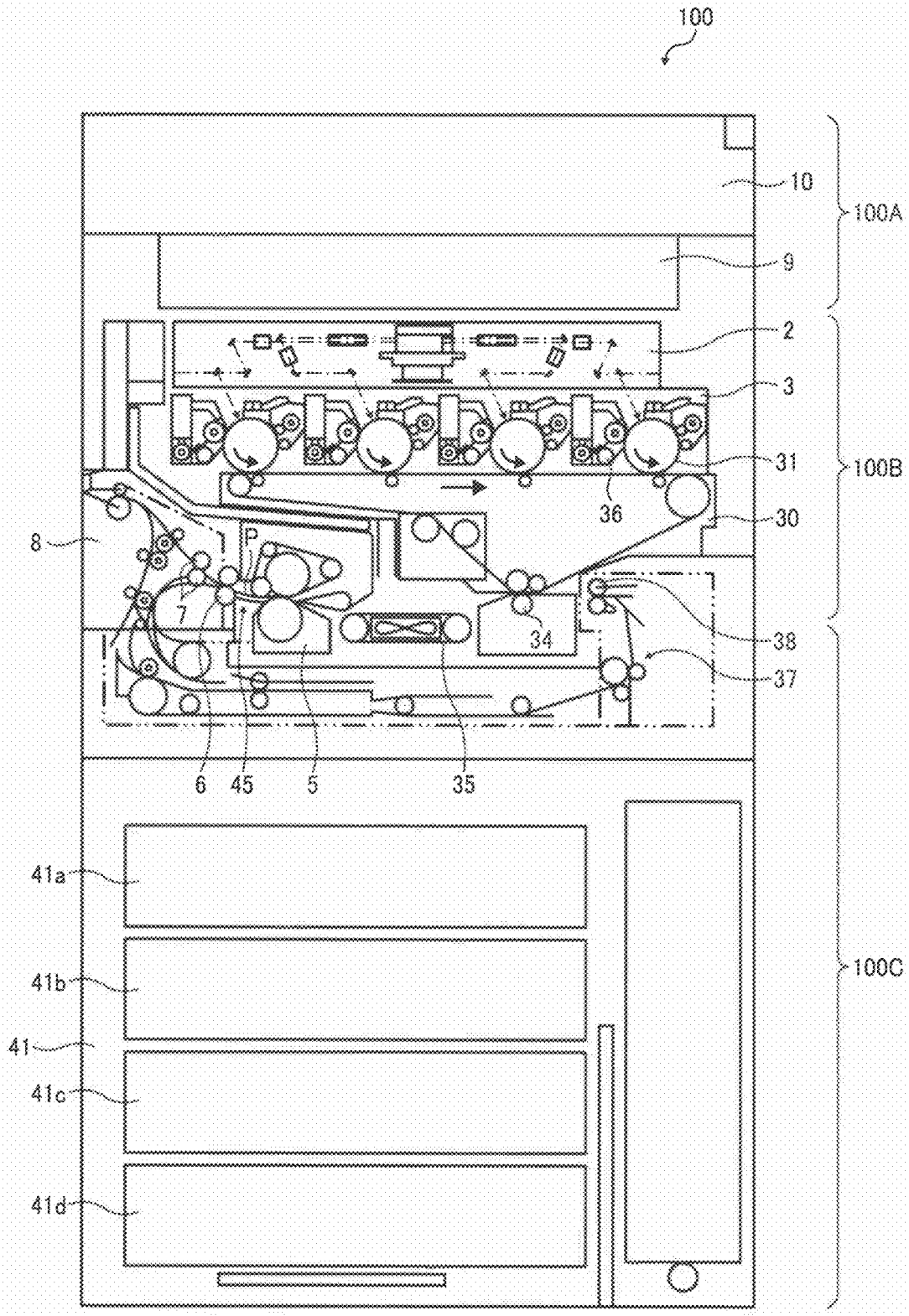
FIG. 1 schematically illustrates an image forming apparatus according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 100 according to one embodiment of this patent specification.

As shown in FIG. 1, the image forming apparatus 100 is a digital imaging system in which various functionalities are combined together to form a freestanding unit, with an image scanning section 100A at the top, a printer section 100B in the middle, and a sheet feeding section 100C at the bottom.

The scanning section 100A includes an optical scanner 9 and an automatic document feeder (ADF) 10 to which an original document is supplied by a user. The ADF 10 can convey original documents in succession for processing through the scanner 9, which then optically scans the face of the original to capture image data of subtractive primary colors (i.e., red, green, and blue) for forwarding to the printer section 100B.

The printer section 100B comprises a tandem color printer that forms a color image by combining images of yellow, magenta, and cyan (i.e., the complements of the three primary colors) as well as black. The printer section 100B includes four electrophotographic imaging stations 4 adjacent to a write scanner 2, arranged in series substantially laterally along the length of an intermediate transfer belt 30.

Each imaging station 4 includes a drum-shaped photoconductor 31 rotatable counterclockwise in the drawing, surrounded by various pieces of imaging equipment 3, such as a charging device, a development device accommodating toner, a primary transfer device, etc., to form an image with toner particles of a particular color on the photoconductive surface for transfer to the intermediate transfer belt 30, as well as a drum cleaner 36 to clean the photoconductive surface after image transfer.

The intermediate transfer belt 30 is trained around a motor-driven roller and other support rollers to rotate clockwise in the drawing, with its outer surface passing through the series of imaging stations 4 while in contact with a secondary transfer roller 34 located opposite one of the belt support rollers.

Also included in the printer section 100B are a fixing device 5, a secondary fixing or glossing device 6, and a guide assembly 45 according to this patent specification, which, together with a conveyance belt 35 and a pair of conveyance rollers 7, define a post-transfer sheet conveyance path P along which a recording medium S, such as a sheet of paper, travels from between the intermediate transfer belt 30 and the secondary transfer roller 34 through the fixing device 5 and then the glossing device 6 for output outside the apparatus body through an ejection unit 8.

The sheet feeding section 100C includes multiple sheet trays 41*a* through 41*d* each accommodating a stock of recording sheets, as well as multiple rollers, including a pair of registration rollers 38, or similar conveyor parts, together defining a pre-transfer sheet conveyance path 37 along which a recording sheet travels from the sheet tray 41 to between the intermediate transfer belt 30 and the secondary transfer roller 34.

During operation, in the printer section 100B, each imaging station 4 rotates the photoconductor drum 31 to pass the photoconductive surface through a series of imaging processes. Initially, the photoconductive surface is charged by the charging device to a given uniform potential, and then selectively discharged by the optical scanner 2 to form an electrostatic latent image according to image data supplied externally or forwarded from the scanning section 100A. Subsequently, the developing device applies toner to the photoconductive surface to render the latent image into a visible toner image, which is then primarily transferred to the surface of the intermediate transfer belt 30 under an electrostatic field.

Such imaging and transfer processes take place in the respective imaging stations 4 as the intermediate transfer belt 30 rotates, so that the transferred toner images are superimposed one atop another to form a single composite image on the moving belt surface. The multicolor toner image thus obtained is forwarded to the secondary transfer roller 34.

In the sheet feeding section 100C, a recording sheet travels along the pre-transfer conveyance path 37 from the sheet tray 41 to between the pair of registration rollers 38. The roller pair 38 holds the incoming sheet for de-skewing and registration, and then forwards it to the secondary transfer roller 34 in coordination with the intermediate transfer belt 30 forwarding the toner image. As a result, the toner image is secondarily transferred to the recording sheet between the intermediate transfer belt 30 and the secondary transfer roller 34.

After secondary transfer, the recording sheet advances along the post-transfer conveyance path P into the fixing device 5 and then into the glossing device 6. The fixing device 5 fixes the toner image in place on the recording sheet with heat and pressure, followed by the glossing device 6 processing the sheet with heat to provide gloss to the fixed image if required. Afterwards, the finished print is conveyed by the rollers 7 to outside the apparatus body through the ejection unit 8, which completes one operational cycle of the image forming apparatus 100.

According to this patent specification, the image forming apparatus 100 can selectively print a recording sheet S of a given thickness or weight per ream either in a gloss mode or in a non-gloss mode, for example, according to a user specifying the mode of operation through a display monitor or any suitable user interface.

To print a sheet of glossy paper such as coated paper that has a relatively high gloss ranging from approximately 30 to 50%, the image forming apparatus 100 operates in the gloss mode to form an image with as much gloss as the surface of the paper in use has, which is suitable for printing gravure pictures. To print a sheet of normal copy paper with a relatively low gloss, the image forming apparatus 100 operates in the non-gloss mode to form an image without gloss, which is suitable for printing text or the like.

Such glossing process is performed using the fixing device 5 and the glossing device 6 arranged along the post-transfer conveyance path P, each of which can operate in different ways depending on the operation mode specified as well as the type of recording sheet in use, so as to provide good fixing and glossing performance for a wide range of recording sheets accommodated in the image forming apparatus 100, as will be described later in more detail.

Figure 2:
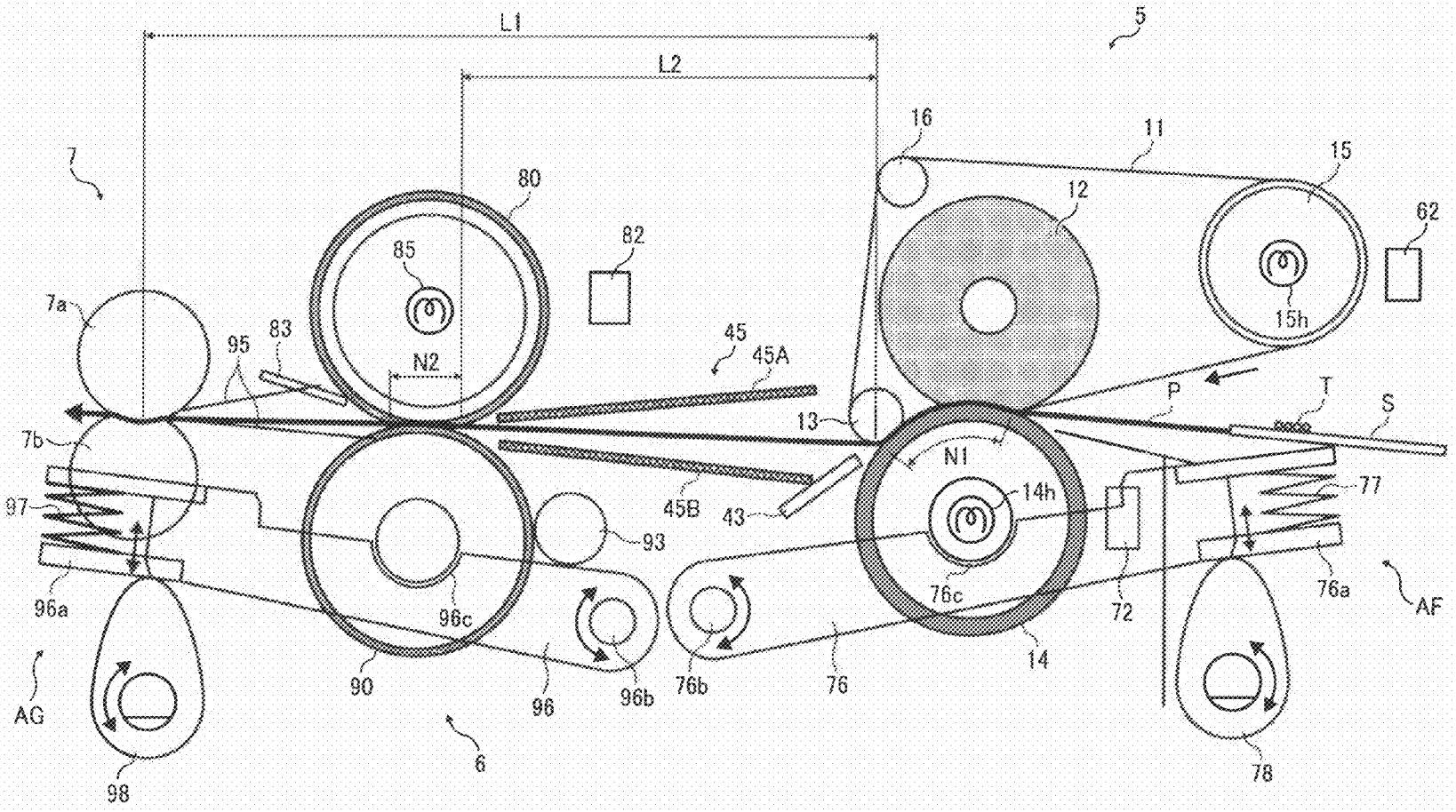
FIG. 2 is an end-on, axial view schematically illustrating a sheet conveyance path of the image forming apparatus of FIG. 1, along which are disposed a fixing device, a glossing device, and a guide assembly according to one embodiment of this patent specification.

FIG. 2 is an end-on, axial view schematically illustrating the post-transfer conveyance path P of the image forming apparatus 100 along which are disposed the fixing device 5, the glossing device 6, and the guide assembly 45 according to this patent specification.

As shown in FIG. 2, the fixing device 5 and the glossing device 6 are arranged in series from upstream to downstream in the post-transfer conveyance path P along which a recording sheet S travels in a direction of arrow from the transfer process toward the conveyance roller pair 7.

Between the fixing device 5 and the glossing device 6 is the guide assembly 45 according to this patent specification. As will be described later in more detail, the guide assembly 45 includes a pair of guide plates 45A and 45B angled with respect to each other to define a tapered gap or sheet passageway therebetween, which narrows from upstream to downstream along the conveyance path P to pass the recording sheet S from the fixing device 5 toward the glossing device 6. A similar pair of guide plates 95 may be disposed between the glossing device 6 and the conveyance roller pair 7, angled with respect to each other to define a tapered sheet passageway therebetween, which narrows from upstream to downstream along the conveyance path P to introduce the recording sheet S from the glossing device 6 toward the conveyance roller pair 7.

Specifically, in the image forming apparatus 100, the fixing device 5 includes a fuser belt 11 looped around a primary fuser roller 12, a sheet separator or secondary fuser roller 13, a heat roller 15, and a tension roller 16, as well as a pressure roller 14 pressed against the primary and secondary fuser rollers 12 and 13 through the fuser belt 11 at a variable pressure with a pressure adjuster AF to define a heated area of contact or nip N1, through which a recording sheet S is passed to fix a toner image T in place under heat and pressure. A sheet separator 43 is disposed adjacent to the pressure roller 14 with its edge held against the roller surface to allow the processed sheet S to smoothly exit the fixing nip N without jamming or wrapping around the pressure roller 14.

The fuser belt 11 comprises a multi-layered endless belt formed of a substrate of suitable material with high resistance to heat, low coefficient of thermal expansion, and relatively high strength, such as nickel, stainless steel, or preferably polyimide, covered with an intermediate layer of elastic material such as silicone rubber, and an outer layer of release agent such as fluorocarbon resin that effects good stripping of toner from the outer surface. For example, a triple-layered belt approximately 115 mm long along its inner circumference may be used, consisting of a substrate of polyimide resin, an intermediate layer of silicone rubber approximately 200 μm thick, and an outer layer of tetra fluoro ethylene-perfluoro alkylvinyl ether copolymer or Perfluoroalkoxy (PFA) deposited through tube coating or other coating method.

The primary fuser roller 12 comprises a cylindrical roller formed by covering a hollow, cylindrical core with a layer of heat-resistant, elastic material, such as silicone rubber in the form of solid, sponge, or foam. For example, a roller approximately 65 mm in diameter formed of a cylindrical core coated with silicone foam approximately 14 mm in thickness may be used.

The secondary fuser roller 13 comprises a cylindrical roller formed of a cylindrical metal core smaller in diameter than that of the primary fuser roller 12, which serves as a heat pipe to uniformly distribute heat along the roller length, covered with a layer of heat-resistant, elastic material, such as silicone rubber in the form of solid, sponge, or foam, softer than that of the primary fuser roller 12. For example, a roller approximately 16 mm in diameter formed of a hollow aluminum core with its wall approximately 1 mm thick coated with silicone foam may be used. The secondary fuser roller 13 has its rotational axis displaceable with respect to the rotational axis of the primary fuser roller 12.

The tension roller 16 is held against the inner circumference of the looped belt 11 rotating past the secondary fuser roller 13 toward the heat roller 15. The roller 16 serves to maintain an adequate tension on the fuser belt 11, for example, by exerting a tension of approximately 9.8 N at opposing sides of its length to apply a total tension of approximately 19.6 N across the width of the fuser belt 11.

The heat roller 15 comprises a hollow cylindrical roller formed of suitable material, such as aluminum or iron. For example, a hollow aluminum cylinder approximately 35 mm in diameter and approximately 0.6 mm in radial thickness may be used. The heat roller 15 is internally heated by a heater 15*h*, which includes any suitable heat source, such as a halogen heater or an induction heater, disposed inside the hollow roller 15 or any location inside the belt loop adjacent the heat roller 15 and apart from the fixing nip N1 where the belt 11 is pressed between the fixing rollers 12 and 14. A thermometer 62 to sense temperature of the surface of the fuser belt 11 being heated with the roller 15 is disposed near the heat roller 15.

The pressure roller 14 comprises a cylindrical roller formed of a hollow, cylindrical metal core of aluminum or iron covered with a layer of heat-resistant, elastic material, such as silicone rubber in the form of solid, sponge, or foam. For example, a roller approximately 65 mm in diameter may be used, consisting of a hollow, cylindrical steel core approximately 1 mm in radial thickness covered with an inner layer of silicone rubber approximately 1.5 mm in thickness, and an outer layer of PFA deposited through tube coating or other suitable coating methods. The pressure roller 14 is equipped with a drive motor, not shown, that imparts rotational force to the fixing device 5, while internally heated by a heater 14*h*, which includes any suitable heat source, such as a halogen heater or an induction heater, disposed inside the hollow roller 14.

Disposed near the pressure roller 14 is a thermometer 72 to sense temperature of the roller surface, according to which the roller heater 14*h* switches on and off to maintain the surface temperature at a sufficiently high level so as to prevent the roller surface from absorbing heat from a recording sheet S within the fixing nip N1. Optionally, the pressure roller 14 may have a web cleaning unit, not shown, that removes residual toner and paper dust from the roller surface, where required.

The pressure adjuster AF includes a pressure lever 76 having an intermediate member 76*a* at one, free end, a hinge 76*b* at another, hinged end, and a bearing 76*c* between the free and hinged ends to support the rotational axis of the pressure roller 14. The pressure adjuster AF also has a spring 77 connected to the free end of the lever 76 through the intermediate member 76*a*, and a cam 78 connected to a suitable driving mechanism, not shown, that imparts rotational force from outside the fixing device 5. The pressure adjuster AF may be configured without the spring 77, in which case the cam 78 connects to the free end of the lever 76 through the intermediate member 76*a*.

The pressure adjuster AF can press the pressure roller 14 against the fuser roller 12 at a variable nip pressure to establish a variable nip length N1.

Specifically, the pressure adjuster AF may hold the pressure roller 14 against the fuser rollers 12 and 13 through the belt 11 to establish the fixing nip N1 between the roller 14 and the belt 11, or away from the fuser rollers 12 and 13 to create a gap between the roller 14 and the belt 11. When pressed against the fuser roller 12, the pressure roller 14 digs a certain depth (e.g., approximately 2 to 4 mm) into the fuser roller 12 through the thickness of belt 11. Thus, the fixing nip N1 has a certain length along the sheet conveyance path P (i.e., along the circumferences of the rollers), and the extent of this length varies proportionally with the nip pressure.

For example, the nip pressure is increased by rotating the cam 78 counterclockwise in the drawing to force the intermediate member 76*a* upward, which in turn causes the spring 77 to press the free end of the pressure lever 76 upward, resulting in the lever 76 swiveled around the hinge 76*b* counterclockwise in the drawing. As the pressure lever 76 thus rotates, the pressure roller 14 moves toward the fuser roller 12 to establish a higher nip pressure and a wider fixing nip N1.

Conversely, the nip pressure is decreased by rotating the cam 78 clockwise in the drawing to allow the intermediate member 76*a* to move downward, which in turn causes the spring 77 to relieve the upward pressure against the free end of the pressure lever 76, resulting in the lever 76 swiveled around the hinge 76*b* clockwise in the drawing. As the pressure lever 76 thus rotates, the pressure roller 14 moves away from the fuser roller 12 to establish a lower nip pressure and a narrower fixing nip N1.

During operation, the motor-driven pressure roller 14 rotates counterclockwise in the drawing in pressure contact with the fuser belt 11, which rotates clockwise in the drawing under appropriate tension. The fuser belt 11 is heated to a temperature sufficient to melt toner particles as it rotates with the heat roller 15 heated by the internal heater 15*h* controlled according to readings of the thermometer 62. The pressure roller 14 is heated to a sufficiently high temperature by the internal heater 14*h*.

As a recording sheet S with a toner image T thereon enters the fixing nip N1, the fuser roller 12 and the pressure roller 14 with the fuser belt 11 therebetween together drive the incoming sheet S forward along the conveyance path P (from right to left in FIG. 2). Within the fixing nip N1, heat and pressure melt the toner particles for settling in place on the surface of the incoming sheet S.

Specifically, the fixing nip N1 consists of an upstream, primary zone defined between the primary fuser roller 12 and the pressure roller 14, a downstream, secondary zone defined between the secondary fuser roller 13 and the pressure roller 14, and an intermediate zone where neither of the fuser rollers 12 and 13 faces the pressure roller 14 between the primary and secondary zones.

Upon reaching the fixing nip N1, the recording sheet S first enters the primary zone, which has a greater extent and exerts a relatively high nip pressure to almost thoroughly fuse the toner into a highly viscous state. Viscosity of the toner image T allows the recording sheet S to adhere to the moving surface of the fuser belt 11 throughout the intermediate zone, which exerts a moderate nip pressure for ensuring secure adhesion of the incoming sheet S without causing undesirable gloss on the printed image T. Then, the recording sheet S reaches the secondary zone, which exerts a relatively high nip pressure to complete processing through the fixing nip N1.

At the exit of the fixing nip N1, the recording sheet S can exhibit close attachment to the surface of the fuser belt 11 or to the surface of the pressure roller 14 after processing through intense heat and pressure. Should the sheet S remain attached to the fuser belt 11 after fixing, the secondary fuser roller 13 causes the sheet S to strip off the belt surface owing to its relatively great surface curvature. Alternatively, should the sheet S remain attached to the pressure roller 14 after fixing, the sheet separator 43 causes the sheet S to strip off the roller surface by slipping its operating edge between the roller surface and the recording sheet S.

The recording sheet S thus exiting the fixing device 5 then proceeds to the glossing device 7 through the guide assembly 45 according to this patent specification, which provides reliable sheet passage from the fixing nip N1 to the glossing nip N2 without jamming and creasing along the conveyance path P, even where the recording sheet S is deformed or deviated after processing through the fixing device. A detailed description of the configuration and operation of the guide assembly 45 will be given with reference to FIG. 3 and subsequent drawings.

As mentioned, the fixing device 5 can adjust the length of the fixing nip N with the pressure adjuster AF. Such adjustment for nip length and pressure is performed to obtain a desired gloss of the resulting print, depending on the mode of operation in which the image forming apparatus 100 is operated to process a specific type of recording sheet S having a certain level of gloss, and depending on the thickness of recording sheet in use to provide a desired appearance or gloss level in either mode of operation.

Specifically, the fixing device 5 establishes a relatively deep, wide, long fixing nip where the image forming apparatus 100 processes a sheet of gloss coated paper in the gloss mode, and a relatively shallow, narrow, short fixing nip where the image forming apparatus 100 processes a sheet of normal copy paper in the non-gloss mode.

With a constant conveyance speed at which the recording sheet S travels along the conveyance path P, the length of the fixing nip N is proportional to the length of nip dwell time during which the traveling sheet S is passed under heat through the fixing nip N. Thus, a larger nip length results in a longer dwell time and larger amount of heat applied to the recording sheet S within the fixing nip N1, which provides higher gloss to a resulting image. Conversely, a smaller nip length results in a shorter dwell time and smaller amount of heat applied to the recording sheet S within the fixing nip N1, which provides lower gloss to a resulting image.

More specifically, the fixing device 5 adjusts the nip length in the gloss mode so that an image past the fixing nip N1 has a gloss ranging from approximately 10% to approximately 30%, preferably from approximately 20% to approximately 30%, and more preferably from approximately 25% to approximately 30% or less. Such arrangement ensures a sufficient level of gloss of a finalized image printed on a glossy sheet.

Further, the fixing device 5 establishes a relatively long fixing nip N1 where the recording sheet in use is relatively thick (e.g., a paper sheet weighing approximately 124 to approximately 300 g/m$^2$), and a relatively short fixing nip N1 where the recording sheet in use is relatively thin or of normal thickness.

In a conventional configuration, processing various types of recording sheets without adjusting a fixing nip for varying thickness of recording sheets results in excessive amounts of heat applied to relatively thin recording sheets, or insufficient amounts of heat supplied to relatively thick recordings sheets. Excessive heating can result in undesirably glossy prints obtained through the non-gloss mode operation, whereas insufficient heating can result in insufficient fixing or glossing in the gloss mode operation.

By contrast, with the present invention, the fixing device 5 adjusts the nip length to prevent overheating thinner recording sheets and underheating thicker recording sheets through the fixing nip N1, so as to maintain constant amounts of gloss on resulting prints in both operation modes regardless of the type of recording sheet in use.

For example, consider a specific case in which the fixing device 5 operates with a nip pressure ranging from approximately 15 to approximately 30 N/cm$^2$ at the primary zone, ranging from approximately 5 to approximately 15 N/cm$^2$ at the intermediate zone, and ranging from approximately 15 to approximately 30 N/cm$^2$ at the secondary zone, with the pressure roller 14 digging approximately 3 to 3.5 mm into the primary fuser roller 12 through the fuser belt 11 while pressed against the secondary fuser roller 13 at approximately 9.8 N at opposing sides of the roller length.

Under such conditions, the fixing device 5 may establish a relatively long fixing nip N1 of a total length of approximately 35 mm, consisting of a primary zone of approximately 20 mm, an intermediate zone of approximately 13 mm, and a secondary zone of approximately 2 mm, in the gloss mode, and a relatively short fixing nip N1 of a total length of approximately 29 mm, consisting of a primary zone of approximately 15 mm, an intermediate zone of approximately 13 mm, and a secondary zone of approximately 1 mm, in the non-gloss mode, resulting in a total dwell time of 50 milliseconds or longer during which the recording sheet S travels through the fixing nip N at a given linear speed, which allows for sufficiently heating 300 g/m$^2$-thick recording sheets in the fixing device 5.

Preferably, the nip pressure at the intermediate zone of the fixing nip N1 is greater than approximately 5 N/cm$^2$ and smaller than approximately 15 N/cm$^2$. Too small a nip pressure at the intermediate zone results in failure of a recording sheet to securely adhere to the fuser belt 11 during passage from the primary zone to the secondary zone, whereas too large a nip pressure at the intermediate zone can cause the resulting image to exhibit an improperly high gloss where not desired.

More preferably, the fixing nip N1 has a total nip dwell time of greater than 60 msec and a nip pressure of approximately 15 to approximately 30 N/cm$^2$ over 50% or more of its entire extent in the gloss mode, which ensures sufficient heating and good fixing performance of the fixing device 5 with relatively thick recording sheets.

Thus, owing to the fixing nip with a variable nip length and dwell time, the fixing device 5 according to this patent specification can adjust appearance of images depending on the mode of operation and the type of recording sheet in use, leading to excellent fixing and glossing performance with high speed and high productivity, and a wide range of recording sheets accommodated in the image forming apparatus 100.

With continued reference to FIG. 2, in the image forming apparatus 100, the glossing device 6 includes an internally heated roller 80 and a pressure roller 90, with the pressure roller 90 being pressed against the heat roller 80 by a pressure adjuster AG at a variable pressure to form a glossing nip N2 with a variable length along the conveyance path P downstream from the fixing nip N1.

In the glossing device 6, the heat roller 80 comprises a hollow, cylindrical roller formed of an elongated core of suitable metal, such as aluminum or iron, covered with an outer layer of elastic material such as silicone rubber. A sheet separator 83 is disposed at the exit of the glossing nip N2, with an end angled with respect to the heat roller 80.

The heat roller 80 has its circumference heated by conduction from an internal heater 85, such as a halogen heater, disposed along the elongated metal core. A thermometer 82 is provided adjacent to the circumference of the heat roller 80 that senses temperature of the roller surface, according to which the heater 85 switches on and off to maintain the roller surface at an appropriate temperature.

The pressure roller 90 comprises a cylindrical roller formed of an elongated core of suitable metal, such as aluminum or iron, covered with an outer layer of elastic material such as silicone rubber. The pressure roller 90 is equipped with the pressure adjuster AG, which enables adjustment of the glossing nip N2 in a manner similar to that of the pressure adjuster AF in the fixing device 5.

Disposed adjacent to the glossing device 6, the conveyance roller pair 7 includes a first roller 7*a* formed of a cylindrical body of elastic material, such as chloroprene rubber or silicone rubber, and a second roller 7*b* formed of a cylindrical body of plastic material. Either or both of the conveyance rollers 7*a* and 7*b* is rotatable in contact with each other to drive a recording sheet S along the conveyance path P downstream from the glossing nip N2.

During operation, the heat roller 80 rotates clockwise in the drawing, with its outer surface heated to a moderate, glossing temperature lower than that of the fuser belt 11 in the fixing device 5, while the pressure roller 90 rotates counterclockwise in the drawing in variable pressure contact with the heat roller 80 at the glossing nip N2. As a recording sheet S with a toner image molten and settled thereon through fixing process enters the glossing nip N2, the glossing device 6 processes the incoming sheet under pressure across the glossing nip N2, which is varied with the pressure adjuster AG depending on the mode of operation as well as on the size of the recording medium S passing through the glossing nip N2.

In the gloss mode, the rotating rollers 80 and 90 advances the incoming sheet S therethrough under pressure, with the printed face of the sheet S brought in contact with the smooth surface of the heat roller 80 exerting a relatively moderate amount of heat sufficient to re-melt the surface of the fixed toner layer, thereby leveling and smoothing the image surface to obtain gloss on the resulting image.

In the non-gloss mode, the incoming sheet S passes through the glossing nip N2 with no or relatively low pressure applied thereon, which only drives the sheet S forward without imparting gloss on the resulting image.

After exiting the glossing device 6, the recording sheet S then proceeds to the conveyance roller pair 7 between the guide plates 95. Should the recording sheet S have a curl or bend on the leading edge upon exiting the glossing nip N2, the tapered sheet passageway between the angled guide plates 95 corrects such deformation to direct the leading edge of the sheet S straight along the conveyance path P, thereby introducing the sheet S into the conveyance roller pair 7 smoothly and reliably without creasing or jamming.

Upon receiving the recording sheet S, the conveyance rollers 7*a* and 7*b*, rotating in contact with each other, forward the incoming sheet S to the output unit 8, not shown, which then forwards the sheet S from the post-transfer conveyance path P to outside the image forming apparatus 100.

As will be described later in more detail, the conveyance roller pair 7 is positioned not too far (e.g., within approximately 210 mm) from the fixing device 5, so that the recording sheet S upon reaching the conveyance roller pair 7 has its trailing end still within the fixing nip N1, where the sheet S in use has a certain length along the conveyance path P. Such arrangement allows the conveyance roller pair 7 to properly forward the recording sheet S in the non-gloss mode where the glossing rollers 80 and 90 apply substantially no pressure to the recording sheet S through the glossing nip N2.

Moreover, with the glossing device 80 moderately heating the recording sheet S, the recording sheet S reaching the conveyance roller pair 7 has its printed face cooled sufficiently to a temperature equal to or lower than that upon exiting the fixing nip N1, which prevents undesirable adhesion of toner to the surfaces of the conveyance rollers 7 and the guide plates 95 downstream from the glossing nip N2.

As mentioned above, the glossing temperature at which the heat roller 80 is operated is relatively moderate. This means that fusing is accomplished only superficially and without entirely melting the toner layer or degrading the color of toner, or causing the toner layer to develop excessive adhesion to the fuser roller 80, compared to the fixing device 5 that fuses toner particles intensely and thoroughly into a viscous layer settling on the recording sheet, with a smooth but not glossy surface exhibiting greater adhesion.

Preferably, such glossing temperature is lower than that of the surface of the fuser belt 11 that fuses toner in contact with the surface of a recording sheet, or more specifically, lower than that of the surface of recording sheet exiting the fixing device 5 and higher than that of the surface of recording sheet entering the glossing device 6.

Alternatively, the glossing temperature is in a range determined based on thermal properties of toner used in the image forming apparatus 100, such as above a softening point and below a midpoint between fusing and super-fusing points of toner in use, and preferably, above a softening point and below a fusing point of toner in use.

Thermal properties of toner may be measured using a flow tester, for example, a commercially available capillary and slit die rheometer "SHIMADZU FLOWTESTER model CFT500D" (manufactured by Shimadzu Corporation), which measures viscosity of a molten material based on a flow rate at which a sample of the melt is extruded from a cylinder through a capillary die under constant pressure and rising temperature to determine a softening temperature at which toner becomes sufficiently soft with heat, a fusing temperature at which toner melts into a fluid phase, and a super-fusing temperature at which extrusion of the melt completes during measurement. For example, measurements may be carried out under the following conditions: pressure force of 5 kgf/$cm^2$; temperature rise rate of 3.0° C./min.; die diameter of 1.00 mm; and die length of 10.0 mm.

For example, where the toner in use has a softening point of 60° C., a fusing point of 120° C., and a midpoint between fusing and super-fusing points of 137° C., the glossing temperature may be in a range of approximately 60° C. to approximately 137° C., more preferably, in a range of approximately 60° C. to approximately 120° C., and most preferably, in a range of approximately 80° C. to approximately 100° C. It will be appreciated that the values depicting thermal properties of toner herein are typical average values, given only by way of example, and the properties of toner used in the image forming apparatus 100 may vary due to various factors, such as production conditions and types of colorant and additives used.

Setting the processing temperature of the glossing device 6 in the moderate range eliminates the need for certain structures that are included in a typical fixing device, which leads to a simple and cost-effective design of the glossing device 6. For example, low adhesion of the gloss finished surface allows for good separation of the recording sheet S from the heat roller 80 even with a diameter in the range of 30 mm to 40 mm, in which case the provision of the sheet separator 83 is unnecessary. Moreover, superficial fusing prevents molten toner from contaminating neighboring surfaces, which eliminates the need for regularly cleaning the surface of the pressure roller 90.

Additionally, the glossing device 6 may serve as an auxiliary to the fixing device 5 depending on the material and thickness of recording sheet in use as well as the conveyance speed at which the recording sheet travels through the conveyance path, particularly when processing a thick recording sheet weighing 124 g/$m^2$ or more at a relatively high conveyance speed, in which case the fixing device 5 forwards a recording sheet with a toner image fixed only partially through the fixing nip N1 to the glossing device 6, which then processes the incoming sheet to completely fix the toner image in place.

As in the case of the pressure adjuster AF for the fixing device 5, the pressure adjuster AG can press the pressure roller 14 against the fuser roller 12 at a variable nip pressure to establish a variable nip length N2.

Structurally, the pressure adjuster AG includes a pressure lever 96 having an intermediate member 96*a* at one, free end, a hinge 96*b* at another, hinged end, and a bearing 96*c* between the free and hinged ends to support the axis of the pressure roller 90. The pressure adjuster AG also has a spring 97 connected to the free end of the lever 96 through the intermediate member 96*a*, and a cam 98 connected to a suitable driving mechanism, not shown, that imparts rotational force from outside the glossing device 6. The pressure adjuster AG may be configured without the spring 97, in which case the cam 98 connects to the free end of the lever 96 through the intermediate member 96*a*.

For example, the nip pressure is increased by rotating the cam 98 clockwise in the drawing to force the intermediate member 96*a* upward, which in turn causes the spring 97 to press the free end of the pressure lever 96 upward, resulting in the lever 96 swiveled around the hinge 96*b* counterclockwise in the drawing. As the pressure lever 96 thus rotates, the pressure roller 90 moves toward the heat roller 80 to establish a higher nip pressure and a wider glossing nip N2.

Conversely, the nip pressure is decreased by rotating the cam 98 counterclockwise in the drawing to allow the intermediate member 96*a* to drop downward, which in turn causes the spring 97 to relieve the upward pressure against the free end of the pressure lever 96, resulting in the lever 96 swiveled around the hinge 96*b* counterclockwise in the drawing. As the pressure lever 96 thus rotates, the pressure roller 90 moves away from the heat roller 80 to establish a lower nip pressure and a shorter glossing nip N2.

Thus, the image forming apparatus 100 can adjust the pressure across the glossing nip N2 with the pressure adjuster AG by rotating the cam 98 to move the pressure roller 90 toward or away, or even out of contact with the heat roller 80.

Preferably, in the gloss mode where the glossing device 6 serves to gloss over a printed image through treatment with heat and pressure, the nip pressure is in the range of approximately 15 N/cm$^2$ to approximately 30 N/cm$^2$ on average across the glossing nip N2. In the non-gloss mode where the glossing device 6 serves to forward a recording sheet without glossing, the nip pressure is lower than that for the gloss mode, preferably, lower than approximately 15 N/cm$^2$, and more preferably, lower than approximately 5 N/cm$^2$ on average across the glossing nip N2.

More preferably, the image forming apparatus 100 may vary the nip pressure in the non-gloss mode depending on the size of recording sheet S in use with respect to the layout of the fixing device 5, the glossing device 6, and the conveyance roller pair 7 along the conveyance path P, so as to reduce the risk of causing print defects due to interference between the recording sheet S and the adjacent surfaces within the conveyance path P.

Specifically, with yet continued reference to FIG. 2, the conveyance roller pair 7 is located at a distance L1 from a downstream end of the fixing nip N1, and the glossing device 6 is disposed with an upstream end of the glossing nip N2 located at a distance L2 from a downstream end of the fixing nip N1 in the conveyance path P. The image forming apparatus 100 adjusts nip pressure at the glossing nip N2 in the non-gloss mode depending on the length of recording sheet S in process along the conveyance path P, as compared with a reference value Lref determined adaptively based on the dimensions of recording sheets accommodated in the image forming apparatus 100 as well as the nip-to-nip distances L1 and L2.

More specifically, when processing a recording sheet S longer than the reference length Lref along the conveyance path P in the non-gloss mode, the image forming apparatus 100 holds the pressure roller 90 in contact with the heat roller 80 with the pressure adjuster AG adjusting the nip pressure lower than that used in the gloss mode, so that the sheet S is drawn forward by the glossing rollers 80 and 90 after being driven by the fixing rollers 12 and 14.

Conversely, when processing a recording sheet S shorter than the reference length Lref along the conveyance path P in the non-gloss mode, the image forming apparatus 100 retracts the pressure roller 90 out of contact with the heat roller 80 by the pressure adjuster AG, so that the sheet S is drawn forward by the conveyor roller pair 7 after being driven by the fixing rollers 12 and 14.

As used herein, the reference length Lref denotes a value determined either empirically or theoretically based on the dimensions of recording sheets in consideration of the layout dimensions L1 and L2 of the conveyance path P and other characteristics of the image forming apparatus 100.

For example, the reference length Lref may be set at approximately 257 mm, which equals the length of the longer edge of a B5-size copy sheet or that of the shorter edge of a B4-size copy sheet used in the image forming apparatus 100. In this case, during operation in the non-gloss mode, the image forming apparatus 100 holds the pressure roller 90 against the heat roller 80 at a relatively low pressure by the pressure adjuster AG when processing a recording sheet shorter than 257 mm (e.g., an A4-size copy sheet conveyed with its shorter edge along the conveyance path P), and otherwise retracts the pressure roller 90 away from the heat roller 80 through the pressure adjuster AG.

In another example, the reference length Lref may be set at approximately 210 mm, which equals the length of the shorter edge of an A4-size copy sheet used in the image forming apparatus 100. In this case, during operation in the non-gloss mode, the image forming apparatus 100 holds the pressure roller 90 against the heat roller 80 at a relatively low pressure by the pressure adjuster AG when processing a recording sheet shorter than 210 mm, and otherwise retracts the pressure roller 90 away from the heat roller 80 through the pressure adjuster AG.

In still another example, the reference length Lref may be set at approximately 200 mm, which does not equal the dimensions of commercially available copy sheets used in the image forming apparatus 100. This represents a case in which the reference length Lref is determined based on the layout dimensions of the conveyance path P, for example, by selecting a value greater than L2 and smaller than L1 when L1=210 mm and L2≦182 mm.

In this case, during operation in the non-gloss mode, the image forming apparatus 100 holds the pressure roller 90 against the heat roller 80 at a relatively low pressure by the pressure adjuster AG when processing a recording sheet shorter than 200 mm (e.g., a B5-size copy sheet conveyed with its shorter, 182-mm edge along the conveyance path P). Conversely, the image forming apparatus 100 retracts the pressure roller 90 away from the heat roller 80 through the pressure adjuster AG when processing a recording sheet longer than 200 mm (e.g., an A4-size copy sheet conveyed with its shorter, 210-mm edge along the conveyance path P).

In yet still further example, the reference length Lref may be determined as a threshold, e.g., approximately 210 mm, for preventing a recording sheet from creasing or other print defects caused by loosening or tightening between the fixing and glossing nips N1 and N2 both applying certain nip pressures to the incoming sheet, which does not exceed the distance L1 between the exit of the fixing nip N1 and the conveyance roller pair 7.

Consider a case where the image forming apparatus 100 accommodates an A3-size sheet of relatively thin paper weighing below 80 g/m$^2$, which can develop minute creases by being pinched at both ends, one by the fixing nip N1 and the other by the glossing nip N2, when the roller pairs rotate with little if any difference between their rotating speeds.

In this case, during operation in the non-gloss mode, the image forming apparatus 100 retracts the pressure roller 90 away from the heat roller 80 through the pressure adjuster AG when processing a relatively thin, A3-size paper sheet, which then passes between the glossing rollers 80 and 90 without pressure applied with its leading edge reaching the conveyance roller pair 7 and trailing edge still in the fixing nip N1.

Thus, the image forming apparatus 100 enables reliable conveyance of various types of recording sheets by controlling nip pressure at the glossing nip N2 in the non-gloss mode depending on whether the length of recording sheet S in process along the conveyance path P is longer or shorter than the reference value Lref. In particular, setting the threshold Lref for crease prevention allows a relatively large and thin recording sheet to travel along the conveyance path P reliably without creasing between the fixing and glossing nips N1 and N2, while ensuring good image quality by preventing the printed face of the sheet from interfering with the adjacent surface of the glossing roller.

Preferably, the gap between the heat roller 80 and the pressure roller 90 does not exceed 2 mm when establishing substantially no pressure therebetween. This ensures recording sheets follow the proper conveyance path P, and prevents paper jams at the glossing nip N2 which can occur when the roller gap is excessively large.

Still preferably, the heat roller 80 and the pressure roller 90 have their outer surfaces coated with release agent such as fluorocarbon resin coating. This not only ensures good stripping of recording sheets from the roller surfaces, but prevents distortion and other print defects which would otherwise occur when passing a recording sheet thorough the gap between the glossing rollers 80 and 90 causes the printed face to accidentally touch the surface of the heat roller 80.

Yet still preferably, the glossing device 6 is disposed with respect to the fixing device 5 so that the distance L2 between the exit of the fixing nip N1 (or that of the fixing device 5) and the entrance of the glossing nip N2 be in a range equal to or greater than 40 mm, such as a length ranging from approximately 40 mm to approximately 182 mm, preferably ranging from approximately 60 mm to approximately 182 mm, and more preferably ranging from approximately 70 mm to approximately 150 mm.

The lower limit of the nip-to-nip distance L2 may be determined depending on the characteristic of the image forming apparatus 100, such as in terms of configurations of the fixing nip N1 and the glossing nip N2 with respect to adjacent structures.

For example, setting a nip-to-nip distance L2 below 40 mm is undesirable because closely spacing the fixing and glossing devices 5 and 6 relative to each other results in steep angles of the guide plates 45A and 45B, designed to define inlet and outlet openings of given dimensions therebetween, which results in malfunctioning of the guide plates 45 and eventually causing paper jams between the fixing and glossing nips N1 and N2.

Also, the upper limit of the nip-to-nip distance L2 may be determined based on a minimum length of recording sheet accommodated along the conveyance path P in the image forming apparatus 100. For example, the nip-to-nip distance L2 may be set to approximately 182 mm or shorter when the image forming apparatus 100 accommodates B5-size copy sheets with their shorter edges along the conveyance path P. Similarly, the nip-to-nip distance L2 may be set to approximately 150 mm or shorter for processing half letter-size copy sheets with their shorter edges along the conveyance path P, and to approximately 100 mm or shorter for processing postcards with their shorter edges along the conveyance path P.

Moreover, the nip-to-nip distance L2 may be set to approximately 210 mm or shorter for processing A4-size copy sheets with their shorter edges along the conveyance path P, to approximately 257 mm or shorter for processing B5-size copy sheets with their longer edges along the conveyance path P, in which cases the distance L1 between the exit of the fixing nip N1 and the conveyance roller pair 7 has an upper limit adjusted in accordance with the upper limit of the nip-to-nip distance L2.

Thus, the image forming apparatus 100 can reliably provide two modes of printing with desired appearances, i.e., higher smoothness and gloss for the gloss mode, and lower smoothness and gloss for the non-gloss mode, while enabling adjustment of gloss levels depending on various operational conditions by adjusting the pressures across the fixing nip N1 and the glossing nip N2, respectively.

Now consider specific examples of operation where the image forming apparatus 100 performs printing by controlling the fixing device 5 and the glossing device 6 in different manners depending on the mode of operation selected for specific types of recording medium and image attributes, as well as the size of recording medium accommodated in the post-transfer conveyance path P designed with a distance L1 between the exit of the fixing nip N1 and the conveyance roller pair 7 of 210 mm and a distance L2 between the exit of the fixing nip N1 and the entrance of the glossing nip N2 ranging from 60 to 182 mm.

For example, to print a coated paper sheet S with a gloss of approximately 30% to approximately 50%, the image forming apparatus 100 forms a toner image on the glossy sheet S through electrophotographic imaging processes, and forwards it into the conveyance path P for subsequent fixing and glossing through the fixing device 5 and the glossing device 6 in the gloss mode as follows.

First, the fixing device 5 heats the fuser belt 11 to an appropriate processing temperature through conduction from the heat roller 15 internally heated with the heater 15*h*, while creating a fixing nip N1 of a relatively large length by adjusting the pressure between the fixing rollers 12 and 14 to an appropriate range of approximately 15 to approximately 30 N/cm$^2$ with the pressure adjuster AF.

As the recording sheet S with the powder toner image thereon passes through the fixing nip N1, heat and pressure causes the toner to completely fuse and settle on the sheet surface while exhibiting a level of gloss of 25% or greater. After the fixing process, the recording sheet S advances to the pressure device 6 with the guide plates 45 correcting deformation or deviation of the sheet S during passage along the conveyance path P.

The glossing device 6 heats the surface of the heat roller 80 to an appropriate processing temperature of approximately 80° to 100° C., while creating a glossing nip N2 of a relatively large length by adjusting the pressure between the glossing rollers 80 and 90 to an appropriate range of approximately 15 to approximately 30 N/cm$^2$ with the pressure adjuster AG.

As the recording sheet S with the toner image now fixed passes through the glossing nip N2, heat and pressure causes the toner layer to superficially re-melt and smoothen to exhibit a higher level of gloss substantially equal to that of the coated surface of the recording sheet S, with a difference of gloss between the image and non-image areas within ±15%, and preferably ±10%. After the glossing process, the recording sheet S proceeds along the guide plates 95 to between the conveyance rollers 7, which then forwards the incoming sheet S for subsequent traveling through the conveyance path toward the ejection unit 8 for user pickup.

To print a plain paper sheet S with its length shorter than 210 mm, the image forming apparatus 100 forms a toner image on the sheet S through electrophotographic imaging processes, identifies the size of sheet S, and forwards it into the conveyance path P for subsequent fixing through the fixing device 5 in the non-gloss mode as follows.

First, the fixing device 5 heats the fuser belt 11 to an appropriate processing temperature through conduction from the heat roller 15 internally heated with the heater 15*h*, while creating a fixing nip N1 of a relatively small length by adjusting the pressure between the fixing rollers 12 and 14 to an appropriate range of approximately 15 to approximately 30 $N/cm^2$ with the pressure adjuster AF. Here, the pressure and length of the fixing nip N1 can become as high as those used in the gloss mode where the sheet S in use is relatively thick.

As the recording sheet S with the powder toner image thereon passes through the fixing nip N1, heat and pressure causes the toner to completely fuse and settle on the sheet surface while exhibiting no or limited level of gloss. After the fixing process, the recording sheet S advances to the pressure device 6 with the guide plates 45 correcting deformation or deviation of the sheet S during passage along the conveyance path P.

The glossing device 6 heats the surface of the heat roller 80 to an appropriate processing temperature of approximately 80° to 100° C., while creating a glossing nip N2 of a relatively small length by adjusting the pressure between the glossing rollers 80 and 90 to a sufficiently low range, for example, below approximately 5 $N/cm^2$, with the pressure adjuster AG.

As the recording sheet S with the toner image now fixed passes through the glossing nip N2, the glossing rollers 80 and 90 only drive the incoming sheet S forward along the conveyance path P without applying too much heat and pressure, which would impart additional gloss to the toner layer. After passing through the glossing device 6, the recording sheet S proceeds along the guide plates 95 to between the conveyance rollers 7, which then forward the incoming sheet S for subsequent travel through the conveyance path toward the ejection unit 8 for user pickup.

To print a plain paper sheet S with its length longer than 210 mm, the image forming apparatus 100 forms a toner image on the sheet S through electrophotographic imaging processes, identifies the size of sheet S, and forwards it into the conveyance path P for subsequent fixing through the fixing device 5 in the non-gloss mode as follows.

First, the fixing device 5 heats the fuser belt 11 to an appropriate processing temperature through conduction from the heat roller 15 internally heated with the heater 15*h*, while creating a fixing nip N1 of a relatively small length by adjusting the pressure between the fixing rollers 12 and 14 to an appropriate range of approximately 15 to approximately 30 $N/cm^2$ with the pressure adjuster AF. Here, the pressure and length of the fixing nip N1 can become as high as those used in the gloss mode where the sheet S in use is relatively thick.

As the recording sheet S with the powder toner image thereon passes through the fixing nip N1, heat and pressure causes the toner to completely fuse and settle on the sheet surface while exhibiting no or limited gloss. After the fixing process, the recording sheet S advances to the pressure device 6 with the guide plates 45 correcting deformation or deviation of the sheet S during passage along the conveyance path P.

The glossing device 6 retracts the pressure roller 90 away from the heat roller 80 with the pressure adjuster AG to create a gap of approximately 2 mm or smaller between the glossing rollers 80 and 90, through which the recording sheet S with the toner image now fixed passes along the conveyance path P with substantially no heat and pressure applied thereto, which would impart additional gloss to the toner layer. After passing through the glossing device 6, the recording sheet S proceeds along the guide plates 95 to reach the conveyance rollers 7 with its trailing end still in the fixing nip N1. The conveyance roller pair 7 then forwards the incoming sheet S for subsequent traveling through the conveyance path toward the ejection unit 8 for user pickup.

The combination of fixing device 5 and glossing device 6, the former having a nip dwell time of approximately 30 msec or longer, and preferably approximately 60 msec or longer, and the latter having a nip dwell time of approximately 15 msec in the gloss mode, allows for producing high yields in the gloss mode as well as in the non-gloss mode, leading to consistently high productivity of the image forming apparatus 100 in both modes of operation.

Having the series of fixing device 5 and glossing device 6 both with adjustable nip pressure and length enables the image forming apparatus 100 to switch between the gloss and non-gloss modes without requiring dedicated post-transfer conveyance paths for fixing in both operation modes, leading to compact configuration of the fixing process and overall size reduction of the image forming apparatus.

Moreover, adjusting nip pressure and length in the fixing device and the glossing device allows for printing a wide range of recording media with desired appearance and gloss in both modes of operation. Further, creating and removing the glossing nip depending on the length of recording sheet relative to the dimensions of the conveyance path P ensures reliable sheet conveyance downstream of the fixing process without affecting appearance of image printed in the non-gloss mode.

Having described the basic configuration of the image forming apparatus 100, a detailed description is now given of the configuration and operation of the sheet guide assembly 45 according to this patent specification.

Figure 3:
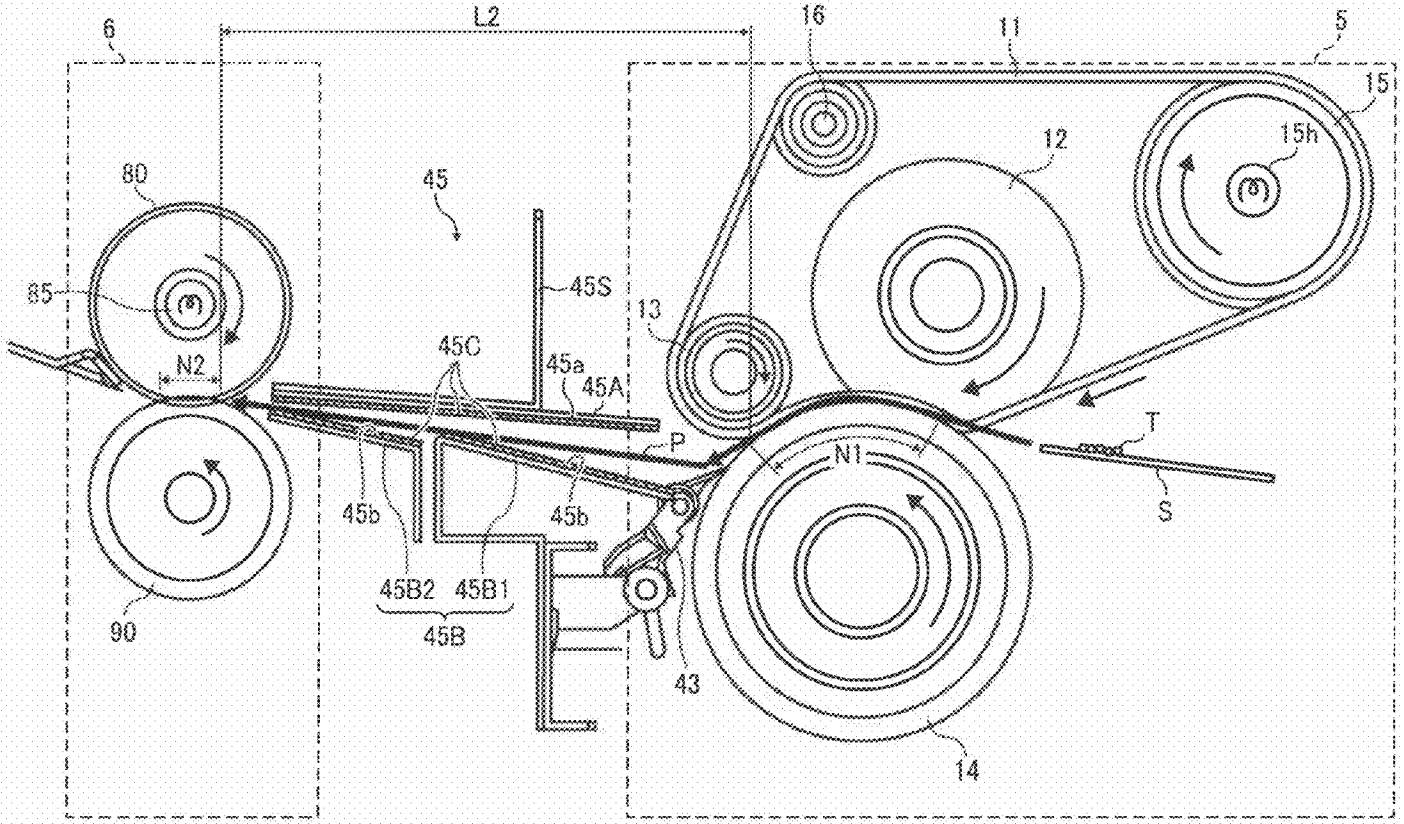
FIG. 3 is another view of the sheet conveyance path of the image forming apparatus, showing in detail the guide assembly according to this patent specification.

FIG. 3 is another view of the post-transfer conveyance path P of the image forming apparatus 100 according to this patent specification, in which the guide assembly 45 is disposed between the fixing device 5 and the glossing device 6 to guide a recording sheet S therethrough.

As shown in FIG. 3, the fixing device 5 has the pressure roller 14 rotating counterclockwise in the drawing and the fuser belt 11 rotating clockwise in the drawing together with the belt supporting rollers 12, 13, 15, and 16. The rotating belt 11 and roller 14 together drive the recording sheet S through the fixing nip N1, with a front, printed side of the sheet S contacting the fuser belt 11 and a back, unprinted side of the sheet S contacting the pressure roller 14. The glossing device 6 has the heat roller 80 rotating clockwise in the drawing and the pressure roller 90 rotating counterclockwise in the drawing, which together drive a recording sheet S through the glossing nip N2.

In the present embodiment, the fixing device 5 and the glossing device 6 are disposed as close as possible to each other for obtaining high processing speed with high thermal efficiency and compact size of the image forming apparatus 100, with the nip-to-nip distance L2 ranging from approximately 40 mm to approximately 182 mm, preferably from approximately 62 mm to approximately 182 mm, and more preferably from approximately 70 mm to approximately 150 mm. High speed processing is accommodated by the fixing device 5 with the elongated fixing nip N1 created by the combination of the primary and secondary fuser rollers 12 and 13, which can intensely heat and press the recording sheet S, even where it is conveyed at high conveyance speed, during the nip dwell time proportional to the length of the fixing nip N1.

Disposed between the fixing and glossing devices 5 and 6 is the guide assembly 45 according to this patent specification, wherein the first and second guide plates 45A and 45B are angled with respect to each other to form the tapered gap or passageway described above therebetween, which narrows upstream to downstream along the conveyance path P with its wider end adjacent to the fixing nip N1 and narrower end adjacent to the glossing nip N2.

In the guide assembly 45, the first guide plate 45A defines a substantially smooth, first guide surface 45*a* to face the front side of the sheet S through the sheet passageway, and the second guide plate 45B defines a second guide surface 45*b* to face the back side of the sheet S through the sheet passageway. Both guide surfaces 45*a* and 45*b* may be either planar or curved in the direction in which the sheet S travels along the conveyance path P, and the first guide surface 45*a* is smooth and continuous with substantially no irregularities or protruding structures along and across the direction of sheet travel along the conveyance path P.

Each of the first and second guide plates 45A and 45B may be a single plate, or a composite plate consisting of two or more separate plates aligned or combined together into an integrated structure. For example, the first guide plate 45A may be braced with a bent support plate 45S bonded to its back side (i.e., the side opposite the guide surface 45*a*), and the second guide plate 45B may include multiple separate sub-plates 45B1 and 45B2 arranged in series to together form the second guide surface 45*b* along the conveyance path P.

During operation, a recording sheet S with a toner image T fixed on its printed side enters the tapered sheet passageway through the wider end upon exiting the fixing nip N1. Throughout the sheet passageway, the incoming sheet S slides between the first and second guide surfaces 45*a* and 45*b*, with its trailing end still within the fixing nip N1 and driven forward by the fixing rollers. Then, the sheet S exits the sheet passageway from the narrower end for subsequent entry into the glossing nip N2.

In such a configuration, a recording sheet S after fixing tends to curl or bend with its leading edge pointing away from the proper conveyance path P upon exiting the fixing nip N1. This is particularly true for the image forming apparatus 100 featuring compact size, high processing speed, and high thermal efficiency through the fixing and glossing processes, where a recording sheet S processed through intense heating and pressure across the fixing nip N1 exhibits closer attachment to the fuser surface due to viscosity of molten toner, thus developing a more pronounced curl or bend than is encountered with a typical fixing process. If not corrected, such deformation or deviation from the proper conveyance path would cause a recording sheet to interfere with adjacent structures to smudge the printed face or jam the glossing nip N2, or otherwise, to crease upon passing through the glossing nip N2.

According to this patent specification, the guide assembly 45 with the tapered sheet passageway formed between the pair of guide plates 45A and 45B can correct deformation or deviation of the recording sheet S, wherein the opposed guide plates 45A and 45B turn the improperly pointed edge of the recording sheet S back toward the proper conveyance path P, while pushing against the curled surface of the recording sheet S to restore its original flat shape during passage from the fixing nip N1 to the glossing nip N2.

Further, the guide assembly 45 with the tapered sheet passageway can reliably introduce the recording sheet S from the fixing nip N1 into the glossing nip N2, wherein the wider, upstream end of the tapered gap allows sufficient clearance for the incoming sheet S to enter the passageway, even where the sheet S has its leading edge significantly pointing away from the conveyance path P after separation from the fuser belt 11 or the pressure roller 14 to which it has been closely attached within the fixing nip N1. Moreover, the narrower, downstream end of the tapered gap restricts movement of the outgoing sheet S away from the conveyance path P, which ensures reliable entry of the sheet S into the glossing nip N2.

In addition, the guide assembly 45 according to this patent specification provides sheet passage without causing undue interference between the recording sheet and the guide surface, which would otherwise result in concomitant print defects as is the case with conventional sheet guide assemblies.

Specifically, in a conventional configuration, a guide assembly employed in sheet conveyance downstream of a fixing nip typically uses a guide plate combined with a protruding tracking structure, such as rollers, spurs, or ribs, that defines an uneven, non-planar guide surface to pass a recording sheet in an intended direction along the sheet conveyance path. Such a configuration is intended to prevent print defects caused by rubbing the printed face of the recording sheet against the guide surface, since the protruding structure, which establishes a point or localized area contact with the recording sheet, reduces the area of contact between the guide surface and the recording sheet.

However, contrary to the intention of the strategy, the conventional guide assembly with protruding structure can adversely affect the print quality. That is, reducing the area of contact translates into a closer contact or increased contact pressure between the recording sheet and the guide surface, which can become unduly high to cause smudges on the recording sheet created by rubbing against the guide surface. The degree of contact pressure depends on the degree of deformation or deviation of the recording sheet, which in turn depends on various operating conditions, such as the material and thickness of recording sheet in use, the operation mode of the fixing and glossing devices, and the processing speed at which the recording sheet is conveyed through the fixing nip.

Moreover, where the recording sheet is significantly deformed, the protruding structure can become an obstruction to the recording sheet passing through the guide assembly, wherein the incoming sheet crushes against the uneven guide surface to cause sheet jamming or creasing along the conveyance path.

By contrast, in the guide assembly 45 according to this patent specification, the smooth guide surface 45*a* of the first guide plate 45A establishes a relatively large contact area with the printed side of a recording sheet S passing through the tapered passageway. Such large-area contact results in a low contact pressure between the first guide surface 45*a* and the recording sheet S, so that it does not adversely affect the quality of printed image where the toner is stabilized to some extent after processing through the fixing nip N1. Moreover, the guide plate 45A without protruding structure on the smooth guide surface 45*a* reduces the risk of crushing the recording sheet S against the guide surface 45*a*.

Hence, the guide assembly 45 according to this patent specification provides reliable sheet passage through the conveyance path P downstream from the fixing device 5, wherein the guide plates 45A and 45B correct deformation and deviation of the recording sheet S upon exiting the fixing nip N1, which prevents concomitant print defects, such as creasing and jamming at the glossing nip N2 or smudges due to interference of the printed face with adjacent surfaces in the conveyance path P.

Preferably, the guide assembly 45 extends substantially over the distance L2 from the downstream end of the fixing nip N1 to the upstream end of the glossing nip N2, ranging, for example, from approximately 40 mm to approximately 182 mm, preferably from approximately 62 mm to approximately 182 mm, and more preferably from approximately 70 mm to approximately 150 mm, so as to guide a recording sheet S substantially throughout the nip-to-nip distance L2 along the conveyance path P.

More preferably, the second guide surface 45*b* of the second guide plate 45B is smooth with substantially no irregularities or protruding structure along and across the direction in which the recording sheet travels through the conveyance path P, as in the case with the first guide surface 45*a*. This prevents print defects during duplex printing, where the second guide surface 45*b* contacts the back side of a recording sheet which has a toner image previously printed and occasionally re-molten due to heating through the fixing nip N1. Nevertheless, the second guide plate 45B may have an additional guide structure, such as rollers, spurs, and ribs, disposed on the second guide surface 45*b* depending on specific configuration of the image forming apparatus 1.

More preferably, the first guide plate 45A has its guide surface 45*a* covered with a layer of release agent 45C such as fluorocarbon resin. Such release layer 45C may also be provided on the guide surface 45*b* of the second guide plate 45B in a configuration where the second guide plate 45B has a substantially smooth guide surface for preventing defects in duplex printing. Provision of the release layer 45C prevents toner from adhering to the smooth guide surface, which has a relatively large area of contact with the printed face of a recording sheet, and thus is susceptible to build-up of accumulated toner. Moreover, this arrangement also prevents sheet creasing or other print defects due to excessively high friction between the guide surface and the sheet surface.

Providing the release agent only on the first and second guide surface 45*bs* is preferred compared to forming the guide plates 45A and 45B of material with a low coefficient of friction such as fluorocarbon resin. This is because a piece of low friction coefficient plastic is costly to manufacture and relatively disadvantaged in terms of mechanical strength and long-term accuracy, and therefore is unsuitable for use as a guide plate for the sheet conveyance path.

The release layer 45C may be created using various manufacturing processes, such as applying a deposit of release agent through a coater, bonding a film of release agent to the guide surface with a double-sided adhesive tape, or molding the guide plate together with a film of release agent into an integrated structure.

More preferably still, the first and second guide plates 45A and 45B have their upstream edges positioned with respect to each other depending on the direction in which a recording sheet S moves upon exiting the fixing nip N1.

Figure 4:
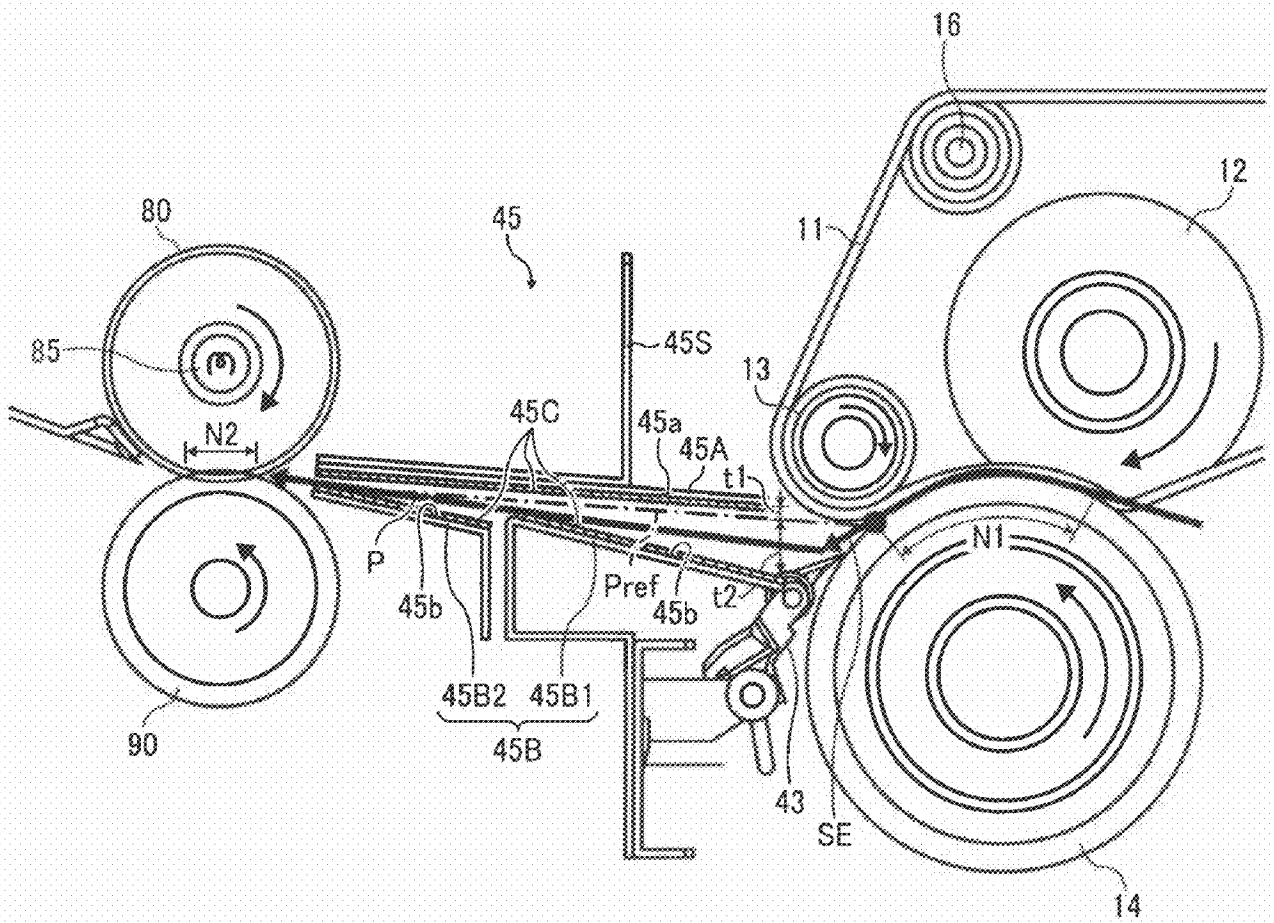
FIG. 4 is still another view of the sheet conveyance path of the image forming apparatus with the guide assembly of FIG. 3.

Specifically, with reference to FIG. 4, which is another view of the sheet conveyance path P of the image forming apparatus 100 showing the guide assembly 45 with an imaginary reference plane Pref connecting the downstream end of the fixing nip N1 and the upstream end of the glossing nip N2, the first guide surface 45*a* has its upstream edge positioned at a first distance t1 from the reference plane Pref, and the second guide surface 45*b* has its upstream edge positioned at a second distance t2 from the reference plane Pref. The first and second distances t1 and t2 are determined relative to each other depending on whether the leading edge SE of a recording sheet S is pointed toward the first guide surface 45*a* or toward the second guide surface 45*b* upon exiting the fixing nip N1.

More specifically, the second distance t2 is greater than the first distance t1 where the sheet leading edge SE is pointed toward the second guide surface 45*b* with respect to the reference plane Pref, as in the embodiment shown in FIG. 4. Conversely, the first distance t1 is greater than the second distance t2 where the sheet leading edge SE is pointed toward the first guide surface 45*a* with respect to the reference plane Pref. Such an arrangement results in sufficient clearance between the guide surface and the sheet edge SE at the entrance of the guide assembly 45, which allows the incoming sheet S to properly enter the sheet passageway without thrusting against the guide surfaces for smoothly proceeding through the conveyance path P.

Yet still more preferably, the guide assembly 45 is used in conjunction with the sheet separator 43 disposed at the exit of the fixing nip N1 to form the assembly with the first and second guide plates 45A and 45B.

Specifically, with continued reference to FIG. 4, the sheet separator 43 may comprise a sharp-edged plate or blade with its sharpened edge held against the pressure roller 14 so that its operating surface, extending from the sharpened edge, leads to the guide surface 45*b* of the second guide plate 45B. Preferably, the sheet separator 43 has its operating surface and edge coated with release agent. More preferably, the operating surface of the sheet separator 43 is arranged substantially in parallel with the leading edge SE of a recording sheet S at the exit of the fixing nip N1.

The sheet separator 43 separates the recording sheet S from the surface of the pressure roller 14 with the sharpened edge slipping between the roller surface and the leading edge SE of the sheet S, where the sheet S has the leading edge SE remaining attached to the roller surface upon exiting the fixing nip N1. After separation from the roller surface, the recording sheet S slides over the operating surface of the separator 43 to reach the second guide surface 45*b* for passing through the conveyance path P. The sheet separator 43 may simply work as a guide surface to lead a recording sheet S into the guide assembly 45, where the sheet S exits the fixing nip N1 with its leading edge SE pointing toward, but not attached to, the surface of the pressure roller 14.

Although the embodiments above describe a fixing device with an endless belt looped around primary and secondary fuser rollers both pressed against a pressure roller through the thickness of belt, the guide assembly 45 according to this patent specification is applicable to various configurations of fixing devices, for example, those as described below with reference to FIGS. 5 through 9.

Figure 5:
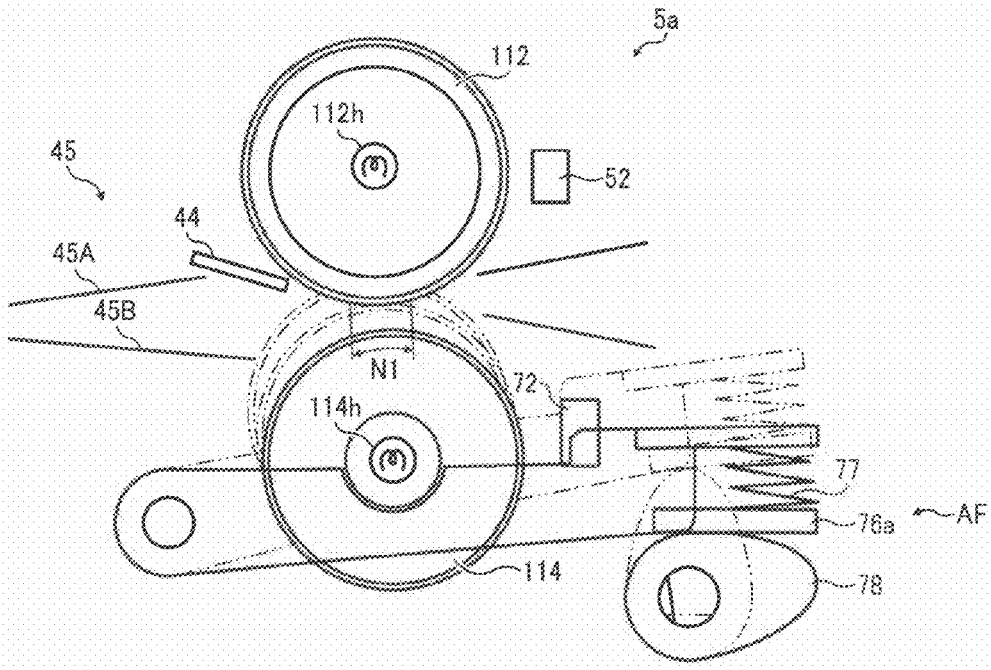
FIG. 5 is an end-on, axial view schematically illustrating a further embodiment of a fixing device for use with the guide assembly according to this patent specification.

FIG. 5 is an end-on, axial view schematically illustrating a further embodiment of a fixing device 5*a* for use with the guide assembly 45 according to this patent specification.

As shown in FIG. 5, the present embodiment is similar to that depicted primarily with reference to FIG. 2, except that it employs a fuser roller 112 pressed directly against a pressure roller 114 to form a fixing nip N1 with adjustable pressure and length, in place of the fuser rollers 12 and 13 pressed against the pressure roller 14 through the fuser belt 11 looped around the rollers 12 and 13 as well as the heat roller 15 and the tension roller 16.

Specifically, in the fixing device 5*a*, the fuser roller 112 comprises a roller formed by covering a hollow, cylindrical metal core with a layer of heat-resistant, elastic material, such as silicone rubber in the form of solid, sponge, or foam. The fuser roller 112 is driven for rotation clockwise in the drawing with its circumference heated by conduction from an internal heater 112*h*. The thermometer 52 is directed toward the surface of the fuser roller 112 before entering the fixing nip N1 to sense the temperature of the roller circumference, according to which the heater 112*h* switches on and off to maintain the fixing nip N1 at a suitable operating temperature.

The pressure roller 114 comprises a roller formed of a hollow, cylindrical core of aluminum or iron covered with a layer of heat-resistant, elastic material, such as silicone rubber in the form of solid, sponge, or foam. The pressure roller 114 is driven for rotation counterclockwise in the drawing, with its circumference heated by conduction from an internal heater 114*h*. The pressure adjuster AF is disposed to press the pressure roller 114 against the fuser roller 112 at a variable nip pressure to establish a variable nip length N1, depending on the thickness of recording sheet in use, and the mode of operation in which the image forming apparatus 100 is operated.

In such a configuration, a recording sheet S before entering the guide assembly 45 tends to remain attached to the surface of the fuser roller 112 upon exiting the fixing nip N1. Such tendency is pronounced in the fixing device 5*a* of FIG. 5, as compared to the embodiment depicted in FIG. 2 which has the secondary fuser roller 13 with a relatively small diameter to provide good stripping of a recording sheet from the fuser belt 11 at the exit of the elongated fixing nip N1.

To compensate for the absence of the sheet separator roller 13, the present embodiment of the guide assembly 45 includes a sheet separator 44 that separates a recording sheet S from the fuser roller 112 for entry into the tapered passageway between the first and second guide plates 45A and 45B. The sheet separator 44 comprises a sharp-edged plate or blade with its sharpened edge held against the fuser roller 112 so that its operating surface, extending from the sharpened edge, leads to the surface 45*a* of the first guide plate 45A. Preferably, the sheet separator 44 has its operating surface and edge coated with release agent. More preferably, the operating surface of the separator 44 is arranged substantially in parallel with the leading edge of a recording sheet S at the exit of the fixing nip N1.

In use, the sheet separator 44 separates the recording sheet S from the surface of the fuser roller 112 with the sharpened edge slipping between the roller surface and the leading edge of the sheet S, where the sheet S has the leading edge remaining attached to the roller surface upon exiting the fixing nip N1. After separation from the roller surface, the recording sheet S slides over the operating surface of the separator 44 to reach the first guide surface 45*a* for passing through the conveyance path P.

In addition to providing sheet stripping from the fuser roller 112, the sheet separator 44 can also correct deformation or deviation of a recording sheet S curling with the leading edge pointing toward the fuser roller 112, wherein the operating surface of the separator 44 turns away the leading edge of a deformed sheet toward the conveyance path P, followed by the surface 45*a* of the first guide plate 45A pressing against the curled surface of the incoming sheet S for flattening and guiding through the proper conveyance path P.

Thus, the guide assembly 45 according to this patent specification provides reliable sheet passage through the conveyance path P downstream from the fixing device 5*a*, wherein the sheet separator 44 together with the guide plates 45A and 45B correct deformation and deviation of the recording sheet S upon exiting the fixing nip N1, which prevents concomitant print defects, such as creasing and jamming at the glossing nip N2 or smudges due to interference of the printed face with adjacent surfaces in the conveyance path P.

Figure 6:
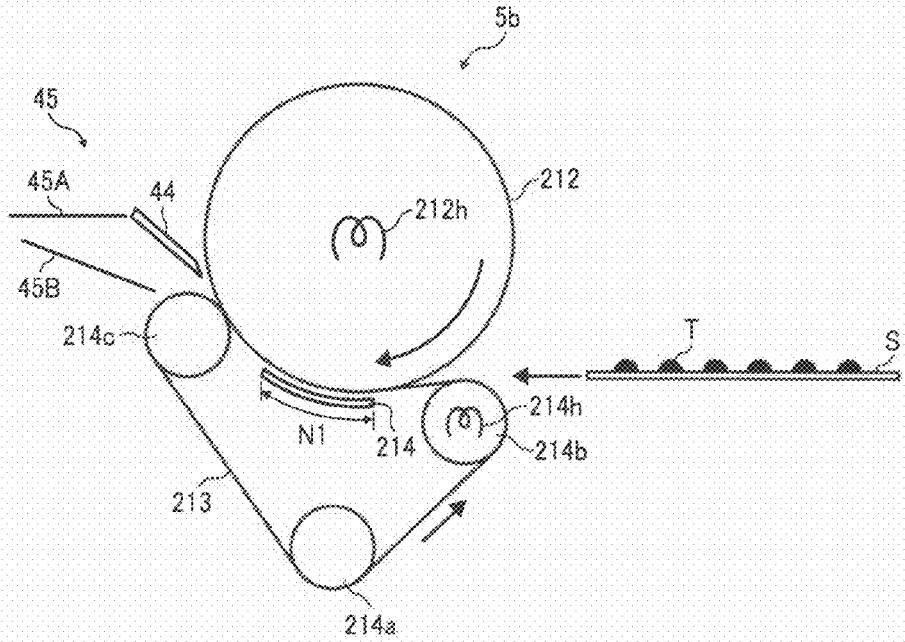
FIG. 6 is an end-on, axial view schematically illustrating a still further embodiment of a fixing device for use with the guide assembly according to this patent specification.

FIG. 6 is an end-on, axial view schematically illustrating a still further embodiment of a fixing device 5*b* for use with the guide assembly 45 according to this patent specification.

As shown in FIG. 6, the present embodiment is similar to that depicted primarily with reference to FIG. 2, except that it employs a fuser roller 212 and a pressure pad 214 pressed against each other through a pressure belt 213 looped around the pressure pad 214 as well as multiple rollers 214*a*, 214*b*, and 214*c* to form a fixing nip N1 with adjustable pressure and length, in place of the fuser rollers 12 and 13 pressed against the pressure roller 14 through the fuser belt 11 looped around the rollers 12 and 13 as well as the heat roller 15 and the tension roller 16.

Specifically, in the fixing device 5*b*, the fuser roller 212 comprises a roller similar to that depicted in FIG. 5, driven for rotation clockwise in the drawing with its circumference heated by conduction from an internal heater 212*h*.

The pressure belt 213 has its support roller 214*b* driven for rotation counterclockwise in the drawing by another support roller 214*a*, with its circumference heated internally heated by a heater 214*h*. The pressure pad 214 comprises an elongated member extending across the width of the pressure belt 213 and formed of any suitable material to provide backing to the belt 213. Although not depicted in the drawing, the pressure adjuster AF is disposed to press the pressure pad 214 against the fuser roller 212 at a variable nip pressure to establish a variable nip length N1, depending on the thickness of recording sheet in use and the mode of operation in which the image forming apparatus 100 is operated.

The present embodiment of the guide assembly 45 uses the sheet separator 44 in conjunction with the first and second guide plates 45A and 45B, as in the embodiment depicted with reference to FIG. 5. The sheet separator 44 comprises a sharp-edged plate or blade with its sharpened edge held against the fuser roller 212 so that its operating surface, extending from the sharpened edge, leads to the surface 45*a* of the first guide plate 45A. Preferably, the sheet separator 44 has its operating surface and edge coated with release agent. More preferably, the operating surface of the separator 44 is arranged substantially parallel with the leading edge of a recording sheet S at the exit of the fixing nip N1.

In use, the sheet separator 44 separates the recording sheet S from the surface of the fuser roller 212 with the sharpened edge slipping between the roller surface and the leading edge of the sheet S, where the sheet S has the leading edge remaining attached to the roller surface upon exiting the fixing nip N1. After separation from the roller surface, the recording sheet S slides over the operating surface of the separator 44 to reach the first guide surface 45*a* for passing through the conveyance path P.

In addition to providing sheet stripping from the fuser roller 212, the sheet separator 44 can also correct deformation or deviation of a recording sheet S curling with the leading edge pointing toward the fuser roller 212, wherein the operating surface of the separator 44 turns away the leading edge of a deformed sheet toward the conveyance path P, followed by the surface 45*a* of the first guide plate 45A pressing against the curled surface of the incoming sheet S for flattening and guiding through the proper conveyance path P.

Thus, the guide assembly 45 according to this patent specification provides reliable sheet passage through the conveyance path P downstream from the fixing device 5*b*, wherein the sheet separator 44 together with the guide plates 45A and 45B correct deformation and deviation of the recording sheet S upon exiting the fixing nip N1, which prevents concomitant print defects, such as creasing and jamming at the glossing nip N2 or smudges due to interference of the printed face with adjacent surfaces in the conveyance path P.

Figure 7:
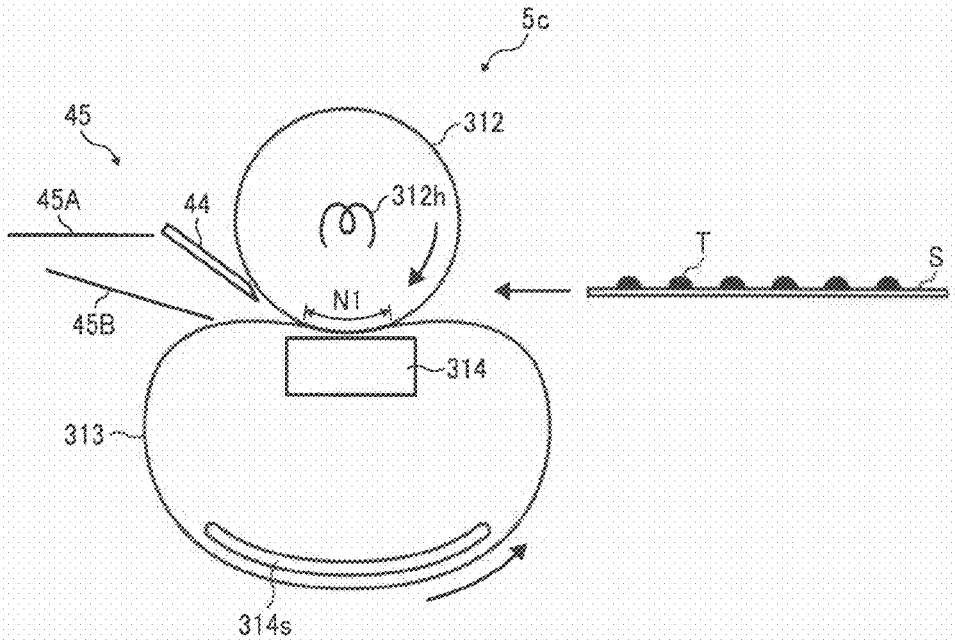
FIG. 7 is an end-on, axial view schematically illustrating a still further embodiment of a fixing device for use with the guide assembly according to this patent specification.

FIG. 7 is an end-on, axial view schematically illustrating another and further embodiment of a fixing device 5*c* for use with the guide assembly 45 according to this patent specification.

As shown in FIG. 7, the present embodiment is similar to that depicted primarily with reference to FIG. 2, except that it employs a fuser roller 312 and a pressure pad 314 pressed against each other through a pressure belt 313 looped loosely around the pressure pad 314 as well as a stationary support 314*s* to form a fixing nip N1 with adjustable pressure and length, in place of the fuser rollers 12 and 13 pressed against the pressure roller 14 through the fuser belt 11 looped around the rollers 12 and 13 as well as the heat roller 15 and the tension roller 16.

Specifically, in the fixing device 5*c*, the fuser roller 312 comprises a roller similar to that depicted in FIG. 5, driven for rotation clockwise in the drawing with its circumference heated by conduction from an internal heater 312*h*.

The loosely looped pressure belt 313 is rotatable counterclockwise in the drawing as the fuser roller 312 rotates. The pressure pad 314 comprises an elongated member extending across the width of the pressure belt 313 and formed of any suitable material to provide backing to the belt 313. Although not depicted in the drawing, the pressure adjuster AF is disposed to press the pressure pad 314 against the fuser roller 312 at a variable nip pressure to establish a variable nip length N1, depending on the thickness of recording sheet in use, and the mode of operation in which the image forming apparatus 100 is operated.

The present embodiment of the guide assembly 45 uses the sheet separator 44 in conjunction with the first and second guide plates 45A and 45B, as in the embodiment depicted with reference to FIG. 5. The sheet separator 44 comprises a sharp-edged plate or blade with its sharpened edge held against the fuser roller 312 so that its operating surface, extending from the sharpened edge, leads to the surface 45*a* of the first guide plate 45A. Preferably, the sheet separator 44 has its operating surface and edge coated with release agent. More preferably, the operating surface of the separator 44 is arranged substantially parallel with the leading edge of a recording sheet S at the exit of the fixing nip N1.

In use, the sheet separator 44 separates the recording sheet S from the surface of the fuser roller 312 with the sharpened edge slipping between the roller surface and the leading edge of the sheet S, where the sheet S has the leading edge remaining attached to the roller surface upon exiting the fixing nip N1. After separation from the roller surface, the recording sheet S slides over the operating surface of the separator 44 to reach the first guide surface 45*a* for passing through the conveyance path P.

In addition to providing sheet stripping from the fuser roller 312, the sheet separator 44 can also correct deformation or deviation of a recording sheet S curling with the leading edge pointing toward the fuser roller 312, wherein the operating surface of the separator 44 turns away the leading edge of a deformed sheet toward the conveyance path P, followed by the surface 45*a* of the first guide plate 45A pressing against the curled surface of the incoming sheet S for flattening and guiding through the proper conveyance path P.

Thus, the guide assembly 45 according to this patent specification provides reliable sheet passage through the conveyance path P downstream from the fixing device 5*c*, wherein the sheet separator 44 together with the guide plates 45A and 45B correct deformation and deviation of the recording sheet S upon exiting the fixing nip N1, which prevents concomitant print defects, such as creasing and jamming at the glossing nip N2 or smudges due to interference of the printed face with adjacent surfaces in the conveyance path P.

Figure 8:
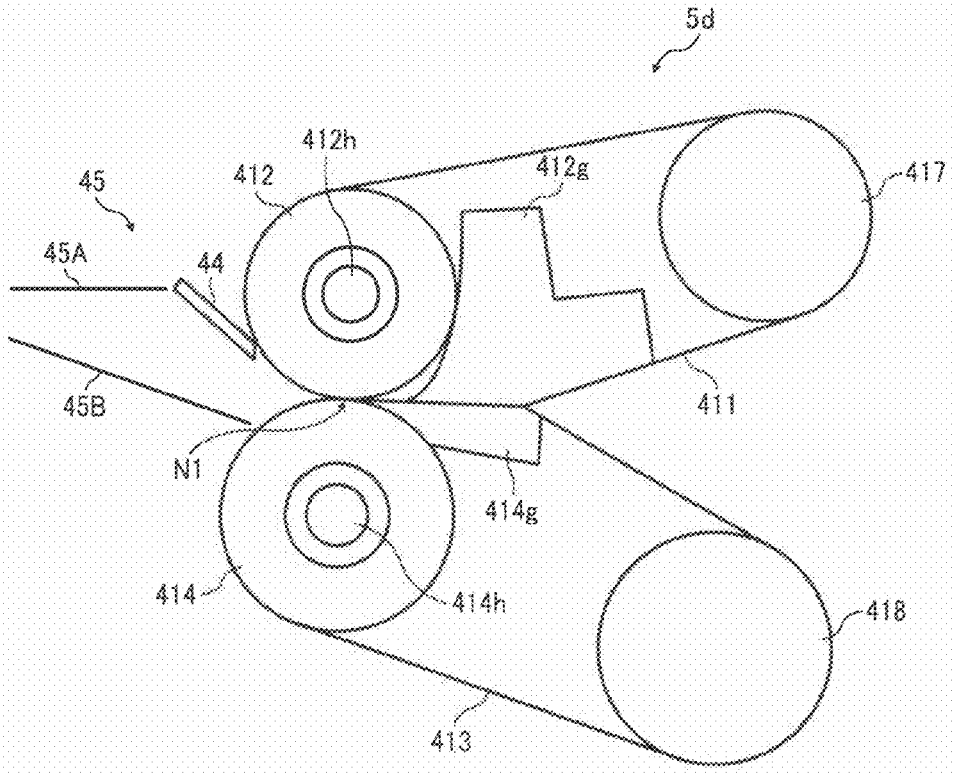
FIG. 8 is an end-on, axial view schematically illustrating a still further embodiment of a fixing device for use with the guide assembly according to this patent specification.

FIG. 8 is an end-on, axial view schematically illustrating a still another and further embodiment of a fixing device 5*d* for use with the guide assembly 45 according to this patent specification.

As shown in FIG. 8, the present embodiment is similar to that depicted primarily with reference to FIG. 2, except that it employs a fuser roller 412 and a pressure roller 414 both internally heated and pressed against each other through a pair of endless belts 411 and 413, the former looped around the fuser roller 412 and the latter around the pressure roller 414, to form a fixing nip N1 with adjustable pressure and length, in place of the fuser rollers 12 and 13 pressed against the pressure roller 14 through the fuser belt 11 looped around the rollers 12 and 13 as well as the heat roller 15 and the tension roller 16.

Specifically, in the fixing device 5*d*, the fuser belt 411 is trained around the fuser roller 412 as well as a roller 417 and a guide 412*g* for rotation clockwise in the drawing. The fuser roller 412 has its circumference heated by conduction from an internal heater 412*h*, which in turn heats the length of the rotating belt 411.

The pressure belt 413 is trained around the pressure roller 414 as well as a roller 418 and a guide 414*g* for rotation counterclockwise in the drawing. The pressure roller 414 has its circumference heated by conduction from an internal heater 414*h*, which in turn heats the length of the rotating belt 413.

The present embodiment of the guide assembly 45 uses the sheet separator 44 in conjunction with the first and second guide plates 45A and 45B, as in the embodiment depicted with reference to FIG. 5. The sheet separator 44 comprises a sharp-edged plate or blade with its sharpened edge held against the fuser belt 411 so that its operating surface, extending from the sharpened edge, leads to the surface 45*a* of the first guide plate 45A. Preferably, the sheet separator 44 has its operating surface and edge coated with release agent. More preferably, the operating surface of the separator 44 is arranged substantially parallel with the leading edge of a recording sheet S at the exit of the fixing nip N1.

In use, the sheet separator 44 separates the recording sheet S from the surface of the fuser belt 411 with the sharpened edge slipping between the roller surface and the leading edge of the sheet S, where the sheet S has the leading edge remaining attached to the belt surface upon exiting the fixing nip N1. After separation from the belt surface, the recording sheet S slides over the operating surface of the separator 44 to reach the first guide surface 45*a* for passing through the conveyance path P.

In addition to providing sheet stripping from the fuser roller 412, the sheet separator 44 can also correct deformation or deviation of a recording sheet S curling with the leading edge pointing toward the fuser belt 411, wherein the operating surface of the separator 44 turns away the leading edge of a deformed sheet toward the conveyance path P, followed by the surface 45*a* of the first guide plate 45A pressing against the curled surface of the incoming sheet S for flattening and guiding through the proper conveyance path P.

Thus, the guide assembly 45 according to this patent specification provides reliable sheet passage through the conveyance path P downstream from the fixing device 5*d*, wherein the sheet separator 44 together with the guide plates 45A and 45B correct deformation and deviation of the recording sheet S upon exiting the fixing nip N1, which prevents concomitant print defects, such as creasing and jamming at the glossing nip N2 or smudges due to interference of the printed face with adjacent surfaces in the conveyance path P.

Figure 9:
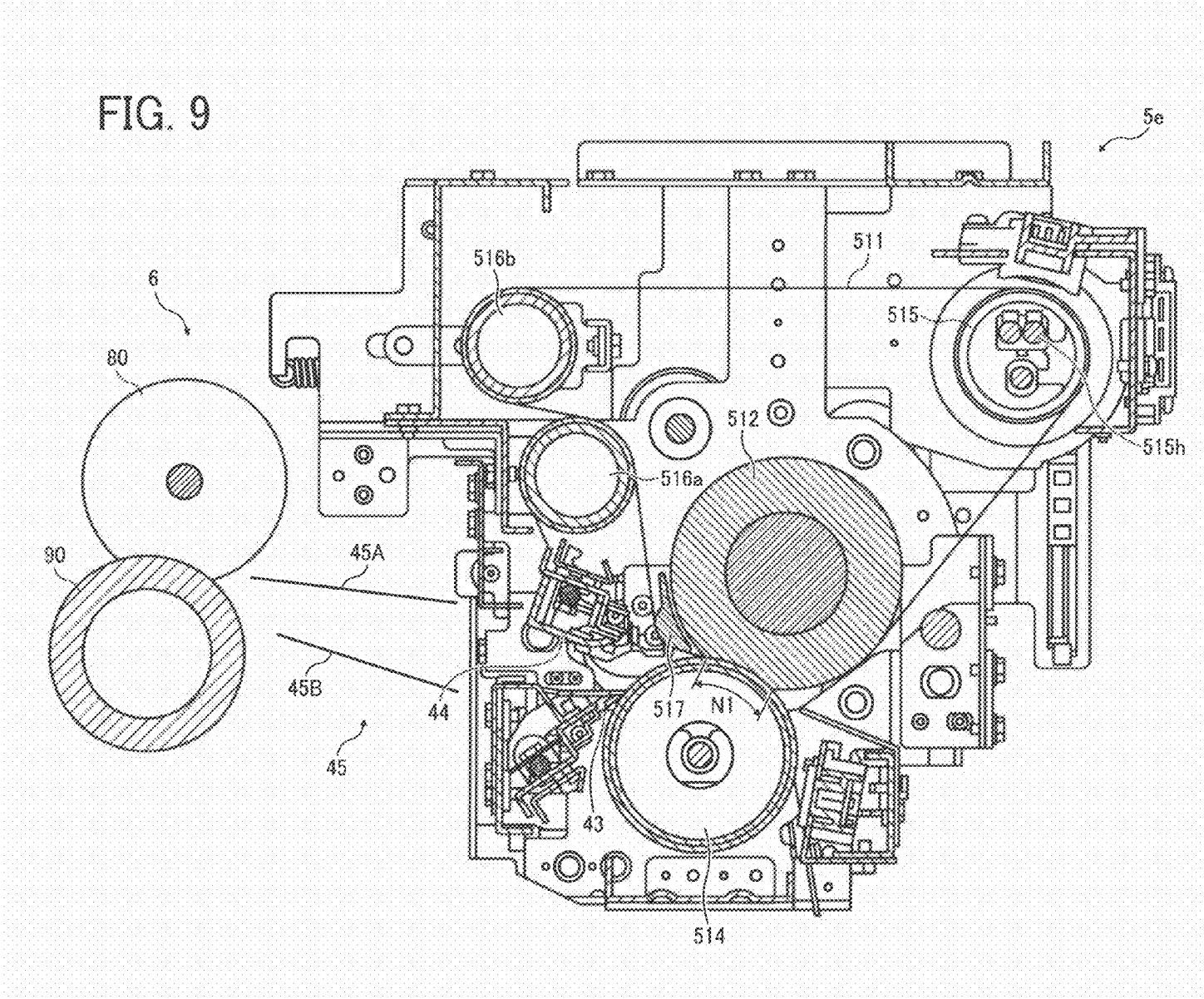
FIG. 9 is an end-on, axial view schematically illustrating a yet still further embodiment of a fixing device for use with the guide assembly according to this patent specification.

FIG. 9 is an end-on, axial view schematically illustrating a yet still another and further embodiment of a fixing device 5*e* for use with the guide assembly 45 according to this patent specification.

As shown in FIG. 9, the present embodiment is similar to that depicted primarily with reference to FIG. 2, except that it employs a single fuser roller 512 with a stationary belt support 517, in place of the primary and secondary fuser rollers 12 and 13, pressed against a pressure roller 514 through a fuser belt 511 looped about the fuser roller 512 as well as a heat roller 515, a tension roller 516, and an additional tension roller 516*a*. The present embodiment of the guide assembly 45 uses the sheet separators 43 and 44, the former disposed adjacent to the pressure roller 514 and the latter adjacent to the fuser belt 511, in conjunction with the first and second guide plates 45A and 45B.

Specifically, in the fixing device 5*e*, the stationary belt support 517 comprises a piece of material more rigid than the heat-resistant elastic layer of the fuser roller 512, held stationary against the inner circumference of the fuser belt 511 adjacent to the fuser roller 512 to establish sliding contact with the rotating belt 511 downstream of the fixing nip N1.

The belt support 517 serves as an alternative to the secondary fuser roller 13 to support the fuser belt 511 in position upon exiting the fixing nip N1. The belt support 517 is superior to the secondary fuser roller 13 in that it prevents print defects due to inconsistent nip pressure along the fixing nip N1. That is, in the embodiment of FIG. 3 using the secondary fuser roller 13, the elongated fixing nip N1 can be inconsistent in nip pressure at the intermediate zone between the upstream and downstream zones. Using the stationary belt support 517 in place of the secondary fuser roller 13 eliminates the intermediate zone to provide consistency and stability throughout the elongated fixing nip N1.

Moreover, the belt support 517 holds the fuser belt 511 in position relative to the sheet separator 44 so as to ensure good functioning of the separator 44 separating the recording sheet from the fuser belt 511. The belt support 517 may be configured in any suitable shape that maximizes performance of the sheet separator 44.

In the present embodiment of the guide assembly 45, the sheet separator 43 comprises a sharp-edged plate or blade with its sharpened edge held against the pressure roller 514 so that its operating surface, extending from the sharpened edge, leads to the surface 45*b* of the second guide plate 45B. Similarly, the sheet separator 44 comprises a sharp-edged plate or blade with its sharpened edge held against the fuser belt 511 so that its operating surface, extending from the sharpened edge, leads to the surface 45*a* of the first guide plate 45A.

In use, the sheet separator 43 separates the recording sheet S from the surface of the pressure roller 514, so that the recording sheet S slides over the operating surface of the separator 43 to reach the second guide surface 45*b* for passing through the conveyance path P.

Similarly, the sheet separator 44 separates the recording sheet S from the surface of the fuser belt 511, so that the recording sheet S slides over the operating surface of the separator 44 to reach the first guide surface 45*a* for passing through the conveyance path P. In addition to providing sheet stripping from the fuser belt 511, the sheet separator 44 can also correct deformation or deviation of a recording sheet S curling with the leading edge pointing toward the fuser belt 511, wherein the operating surface of the separator 44 turns away the leading edge of a deformed sheet toward the conveyance path P, followed by the surface 45*a* of the first guide plate 45A pressing against the curled surface of the incoming sheet S for flattening and guiding through the proper conveyance path P.

Thus, the guide assembly 45 according to this patent specification provides reliable sheet passage through the conveyance path P downstream from the fixing device 5*e*, wherein the sheet separators 43 and 44 together with the guide plates 45A and 45B correct deformation and deviation of the recording sheet S upon exiting the fixing nip N1, which prevents concomitant print defects, such as creasing and jamming at the glossing nip N2 or smudges due to interference of the printed face with adjacent surfaces in the conveyance path P.

Numerous additional modifications and variations are possible in light of the above teachings. For example, although the fixing device is described as being incorporated in the multicolor printer, the fixing device according to this patent specification is applicable to various types of electrophotographic image forming apparatus, such as monochrome printers, photocopiers, facsimiles, or multifunctional machines incorporating several of these imaging functions.

Further, although the image forming apparatus uses the fixing device in combination with the glossing device in several embodiments described herein, the fixing device according to this patent specification may be used alone or in combination with a secondary fixing device instead of a glossing device to complete fixing process along the post-transfer conveyance path.

Figure 10:
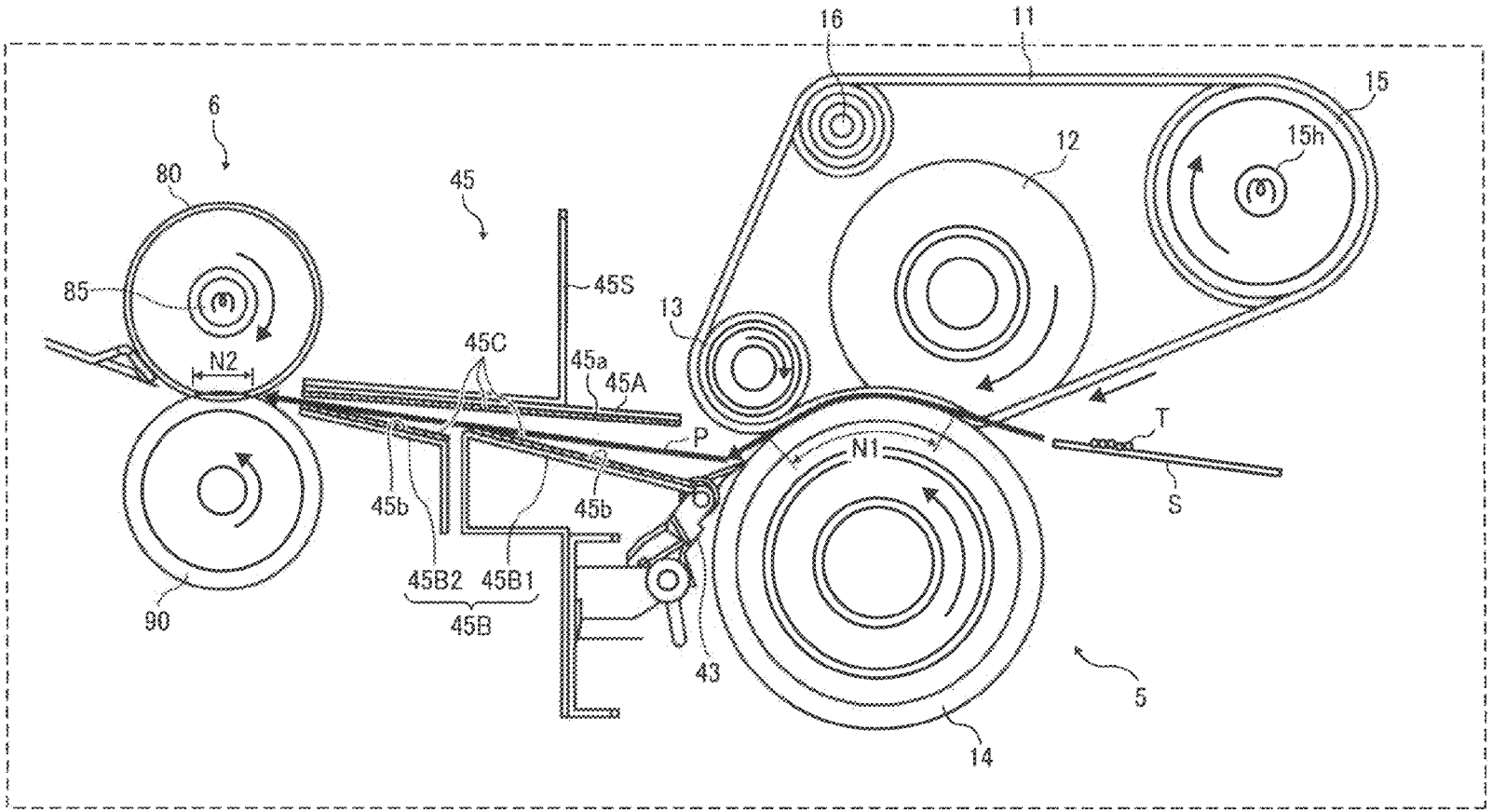
FIG. 10 is still another view of the sheet conveyance path of the image forming apparatus, showing in detail the guide assembly according to this patent specification, integrated with the fixing device and the glossing device for integral mounting in the image forming apparatus.

Furthermore, the fixing device, the glossing device, and the guide assembly according to this patent specification may be configured as separate modules individually installed in the image forming apparatus, as indicated by broken lines in FIG. 3. Alternatively, these units may be configured as a single integrated module integrally mounted in the image forming apparatus, as indicated by broken lines in FIG. 10.

It is therefore to be understood that, within the scope of the appended claims, the disclosure of this patent specification may be practiced otherwise than as specifically described herein.

What is claimed is:

1. An image forming apparatus comprising:

an electrophotographic imaging unit to form a toner image on a recording medium for forwarding to a media conveyance path;

a fixing unit disposed along the conveyance path to fix the toner image in place on the recording medium, the fixing unit having a pair of fixing members, at least one being heated and at least one being pressed against the other one of the pair, to define a fixing nip through which the recording medium is passed under heat and pressure;

a conveyance unit disposed downstream of the fixing unit along the conveyance path to forward the recording medium from the fixing nip; and a guide assembly disposed between the fixing unit and the conveyance unit along the conveyance path to guide the recording medium therethrough, the guide assembly including:

a pair of first and second media guide members to form a tapered passageway therebetween narrowing from upstream to downstream along the conveyance path to pass the recording medium from the fixing nip into the conveyance unit, the first guide member defining a substantially smooth, first guide surface to face a printed side of the recording medium on which the toner image is formed, the second guide member defining a second guide surface to face a back side opposite the printed side of the recording medium, wherein the conveyance unit comprises a glossing device that processes the recording medium with heat and pressure to gloss the toner image after fixing.

2. The image forming apparatus according to claim 1, wherein the first guide surface is covered with a layer of release agent.

3. The image forming apparatus according to claim 1, wherein the tapered passageway formed by the first and second media guide members extends from approximately 40 millimeters to approximately 182 millimeters along the media conveyance path.

4. The image forming apparatus according to claim 1, wherein the fixing unit is configured to discharge the recording medium toward the first guide surface from the fixing nip, and an upstream edge of the first guide surface is positioned at a first distance from a central reference plane within the tapered passageway that is greater than a second distance at which an upstream edge of the second guide surface is positioned from the central reference plane, the central reference plane connecting a downstream end of the fixing nip and an upstream end of the conveyance unit along the conveyance path.

5. The image forming apparatus according to claim 1, wherein the fixing unit is configured to discharge the recording medium toward the second guide surface from the fixing nip, and an upstream edge of the first guide surface is positioned at a first distance from a central reference plane within the tapered passageway that is smaller than a second distance at which an upstream edge of the second guide surface is positioned from the central reference plane, the central reference plane connecting a downstream end of the fixing nip and an upstream end of the conveyance unit along the conveyance path.

6. The image forming apparatus according to claim 1, wherein the guide assembly further includes a media separator held against at least one of the paired fixing members downstream of the fixing nip to separate the recording medium from the fixing member for entry into the tapered passageway.

7. The image forming apparatus according to claim 1, wherein the second guide surface is substantially smooth.

8. The image forming apparatus according to claim 1, wherein the first guide surface is smooth and continuous with substantially no irregularities or protruding structure along and across a direction of media travel along the media conveyance path.

9. An image forming apparatus comprising:

an electrophotographic imaging unit to form a toner image on a recording medium for forwarding to a media conveyance path;

a fixing unit disposed along the conveyance path to fix the toner image in place on the recording medium, the fixing unit having a pair of fixing members, at least one being heated and at least one being pressed against the other one of the pair, to define a fixing nip through which the recording medium is passed under heat and pressure;

a conveyance unit disposed downstream of the fixing unit along the conveyance path to forward the recording medium from the fixing nip; and a guide assembly disposed between the fixing unit and the conveyance unit along the conveyance path to guide the recording medium therethrough, the guide assembly including:

a pair of first and second media guide members to form a tapered passageway therebetween narrowing from upstream to downstream along the conveyance path to pass the recording medium from the fixing nip into the conveyance unit, the first guide member defining a substantially smooth, first guide surface to face a printed side of the recording medium on which the toner image is formed, the second guide member defining a second guide surface to face a back side opposite the printed side of the recording medium, wherein the conveyance unit comprises a secondary fixing device that processes the recording medium with heat and pressure to complete fixing of the toner image.

10. The image forming apparatus according to claim 9, wherein the first guide surface is covered with a layer of release agent.

11. The image forming apparatus according to claim 9, wherein the tapered passageway formed by the first and second media guide members extends from approximately 40 millimeters to approximately 182 millimeters along the media conveyance path.

12. The image forming apparatus according to claim 9, wherein the fixing unit is configured to discharge the recording medium toward the first guide surface from the fixing nip, and an upstream edge of the first guide surface is positioned at a first distance from a central reference plane within the tapered passageway that is greater than a second distance at which an upstream edge of the second guide surface is positioned from the central reference plane, the central reference plane connecting a downstream end of the fixing nip and an upstream end of the conveyance unit along the conveyance path.

13. The image forming apparatus according to claim 9, wherein the fixing unit is configured to discharge the recording medium toward the second guide surface from the fixing nip, and an upstream edge of the first guide surface is positioned at a first distance from a central reference plane within the tapered passageway that is smaller than a second distance at which an upstream edge of the second guide surface is positioned from the central reference plane, the central reference plane connecting a downstream end of the fixing nip and an upstream end of the conveyance unit along the conveyance path.

14. The image forming apparatus according to claim 9, wherein the guide assembly further includes a media separator held against at least one of the paired fixing members downstream of the fixing nip to separate the recording medium from the fixing member for entry into the tapered passageway.

15. The image forming apparatus according to claim 9, wherein the second guide surface is substantially smooth.

16. The image forming apparatus according to claim 9, wherein the first guide surface is smooth and continuous with substantially no irregularities or protruding structure along and across a direction of media travel along the media conveyance path.

* * * * *